US006991326B2

(12) United States Patent
Matsushita et al.

(10) Patent No.: US 6,991,326 B2
(45) Date of Patent: Jan. 31, 2006

(54) INK CARTRIDGE AND IMAGE FORMING APPARATUS

(75) Inventors: Masaki Matsushita, Nara (JP); Hirokazu Nakamura, Nara (JP); Naozumi Ueno, Ikoma (JP); Hisashi Yoshimura, Nara (JP); Takashi Goto, Nara (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 186 days.

(21) Appl. No.: 10/662,354

(22) Filed: Sep. 16, 2003

(65) Prior Publication Data

US 2004/0056935 A1 Mar. 25, 2004

(30) Foreign Application Priority Data

Sep. 17, 2002 (JP) ..... 2002-270725

(51) Int. Cl.
*B41J 2/175* (2006.01)

(52) U.S. Cl. ..... 347/86; 347/87

(58) Field of Classification Search ..... 347/84–87
See application file for complete search history.

(56) References Cited

U.S. PATENT DOCUMENTS 3,708,798 A * 1/1973 Hildenbrand et al. ..... 347/86
4,484,827 A * 11/1984 Price, Jr. ..... 401/205
5,182,579 A 1/1993 Haruta et al.
5,874,974 A * 2/1999 Courian et al. ..... 347/65

* cited by examiner

*Primary Examiner*—Lamson Nguyen
*Assistant Examiner*—Rachel Dicht
(74) *Attorney, Agent, or Firm*—Birch, Stewart, Kolasch & Birch, LLP

(57) ABSTRACT

An ink cartridge includes an ink containing section including an ink absorbing body made of a porous material for retaining ink. The ink cartridge satisfies $200 \leqq N \cdot R \leqq 320$, where N is the cell density, expressed in the number of pores per inch, of the ink absorbing body before the ink absorbing body is contained in the ink containing section; and R is a compressibility, which is a volume ratio of the ink absorbing body when the ink absorbing body is contained in a compressed state in the ink containing section to the ink absorbing body before the ink absorbing body is contained in the ink containing section. With this configuration, it is possible to (1) preventing ink leakage that is caused when the ink cartridge is inserted or detached, (2) realize stable supply of the ink when continuous ejection is performed, and (3) achieve effective utilization of the ink cartridge volume, thereby realizing an ink cartridge and an image forming apparatus which provide design indices for the ink absorbing body in accordance with properties of the ink.

2 Claims, 16 Drawing Sheets

$$Rd = \int_0^X \frac{1}{\left\{ 2\sqrt{(dm/2)^2 - X^2} \right\}^4} \, dX$$

$$Rm = \int_0^X \frac{1}{dm^4} \, dX$$

$$\Delta P = 4T\cos\theta / d$$

$P_c = 4T/d$

INK CARTRIDGE AND IMAGE FORMING APPARATUS

This nonprovisional application claims priority under 35 U.S.C. § 119(a) on Patent Application No(s). 2002-270725 filed in JAPAN on Sep. 17, 2002, which is(are) herein incorporated by reference.

FIELD OF THE INVENTION

The present invention relates to ink cartridges including an ink containing section that contains an ink absorbing body made of a porous material for retaining ink, and to image forming apparatuses including such an ink cartridge, and particularly to ink jet recording apparatuses.

BACKGROUND OF THE INVENTION

Generally, ink jet recording apparatuses that function as image forming apparatuses include an ink cartridge including an ink containing section that contains an ink absorbing body. The ink absorbing body is made of a polymer elastic porous material, such as a polyether-based urethane foam (expandable foam).

The porous material of the ink absorbing body is soaked with ink, and the ink absorbing body is contained in a compressed state in the ink containing section. The ink retained in the porous material is ejected by a capillary action from the ink cartridge to an ink ejecting section via a nozzle, the nozzle being an ink supplying throat provided on the ink containing section.

U.S. Pat. No. 5,182,579 (Date of Patent: Jan. 26, 1993), for example, suggests that the following expression be satisfied as a condition required for such an ink absorbing body:

$$100 \leqq N \cdot R \leqq 200$$

where N is the number of pores per inch (cell density) in the ink absorbing body before the ink absorbing body is contained in the ink containing section (here, N is no larger than 60); and R is the compression ratio (compressibility), which is a volume ratio of the ink absorbing body when it is contained in a compressed state in the ink containing section to the ink absorbing body before it is contained in the ink containing section.

By satisfying the condition above, the ink absorbing body can have required properties for an ink jet cartridge. Such properties include an ability of the ink to perform continuous recording, an ability of the ink to recover, and an ability of the ink to move easily. Such an ink absorbing body is effective even if the porous material is not uniform. Therefore, it is possible to save manufacture cost.

However, a drawback of the foregoing publication is that the ink cartridge cannot use an ink absorbing body whose N·R is greater than 200. This has limited an available range of ink absorbing bodies.

Moreover, the ink cartridge described in the publication above does not consider the properties of the ink absorbed in the ink absorbing body. As a result, depending on the type of the ink used, problems are caused in the ink jet recording apparatus in that the ink is depleted when continuous ejection is performed, and that ink leakage is caused when the ink cartridge is inserted or detached.

SUMMARY OF THE INVENTION

It is therefore a feature of the present invention to provide an ink cartridge and an image forming apparatus that are capable of increasing an available range of design indices for the ink absorbing body.

Another feature of the present invention is to provide an ink cartridge and an image forming apparatus which provide design indices for the ink absorbing body in accordance with properties of the ink, so as to prevent problems such as depletion of the ink caused when continuous ejection is performed, and ink leakage caused when the ink cartridge is inserted or detached.

To solve the problems above, an ink cartridge of the present invention includes an ink containing section including an ink absorbing body made of a porous material for retaining ink, the ink cartridge satisfying:

$$200 \leqq N \cdot R \leqq 320$$

where N is a cell density, expressed in the number of pores per inch, of the ink absorbing body before the ink absorbing body is contained in the ink containing section; and R is a compressibility, which is a volume ratio of the ink absorbing body when the ink absorbing body is contained in a compressed state in the ink containing section to the ink absorbing body before the ink absorbing body is contained in the ink containing section.

In determining an ink retaining power of the ink cartridge, the height of the ink cartridge including the ink containing section, non-uniformity among cells of a foam material (expandable foam) used as the ink absorbing body, and vibration applied to the ink cartridge may be considered. This is because an insufficient ink retaining power causes the problem of ink leakage when the ink cartridge is inserted or detached.

For example, when the height of the ink cartridge is 34 mm, the ink retaining power is 68 (=34×2) mm (0.68 kPa) by head, assuming a safety factor of 2.

Because common cartridges are no higher than approximately 40 mm in height, the head pressure needs to be at least 0.8 kPa. By setting N·R to be no less than 200, an ink retaining power of no less than 86 mm (0.86 kPa) by head can be obtained. Accordingly, this configuration prevents the problem of accidental ink leakage when the ink cartridge is inserted or detached.

When continuous ejection of the ink is performed, the negative pressure generated by a supply system needs to be no larger than approximately 2.0 kPa, considering the safety factor. Otherwise, the negative pressure generated by the supply system causes depletion of the ink. This leads to a problem that air is sucked into the nozzle as the liquid level of the ink retreats too much from an end of the nozzle. As a result, the ink cannot be supplied stably.

By setting N·R to be no larger than 320, the negative pressure generated by the supply system becomes no larger than 1.5 kPa. This makes it possible to stably supply the ink with enough margin when continuous ejection of the ink is performed. Moreover, it is possible to efficiently utilize an ink cartridge volume.

Conventional ink absorbing bodies are used only with N·R of less than 200. However, in the present invention, N·R can be set to equal to or more than 200, as long as N·R does not exceed 320. Therefore, an available range of ink absorbing bodies can be increased.

Thus, by satisfying $200 \leqq N \cdot R \leqq 320$ it is possible to provide an ink cartridge that is capable of increasing an available range of design indices for the ink absorbing body.

It is also possible to provide an ink cartridge that provides design indices for the ink absorbing body in accordance with properties of the ink, so as to prevent problems such as depletion of the ink caused when continuous ejection is performed, and ink leakage caused when the ink cartridge is inserted or detached.

Moreover, to solve the problems above, an ink cartridge of the present invention includes an ink containing section including an ink absorbing body made of a porous material for retaining ink, the ink cartridge satisfying:

$$T \cdot N \cdot R \cdot B \geqq 0.08$$

where T is a surface tension of the ink absorbed in the ink absorbing body, expressed in Newton per meter; N is a cell density, expressed in the number of pores per inch, of the ink absorbing body before the ink absorbing body is contained in the ink containing section; and R is a compressibility, which is a volume ratio of the ink absorbing body when the ink absorbing body is contained in a compressed state in the ink containing section to the ink absorbing body before the ink absorbing body is contained in the ink containing section; and B is a coefficient of B=0.0161.

In this invention, the ink cartridge satisfies $T \cdot N \cdot R \cdot B > 0.08$, where B is a coefficient of B=0.0161.

By setting $T \cdot N \cdot R \cdot B$ to be no less than 0.08, an ink retaining power of no less than 0.8 kPa can be obtained. Accordingly, this configuration prevents the problem of accidental ink leakage when the ink cartridge is inserted or detached.

Moreover, because a difference in the surface tension of the ink absorbed in the ink absorbing body is taken into account, this configuration more certainly prevents the problem of accidental ink leakage when the ink cartridge is inserted or detached.

Moreover, to solve the problems above, an ink cartridge of the present invention includes an ink containing section including an ink absorbing body made of a porous material for retaining ink, the ink cartridge satisfying:

$$T \cdot N \cdot R \cdot B \geqq \gamma \cdot h$$

where T is a surface tension of the ink absorbed in the ink absorbing body, expressed in Newton per meter; N is a cell density, expressed in the number of pores per inch, of the ink absorbing body before the ink absorbing body is contained in the ink containing section; and R is a compressibility, which is a volume ratio of the ink absorbing body when the ink absorbing body is contained in a compressed state in the ink containing section to the ink absorbing body before the ink absorbing body is contained in the ink containing section; B is a coefficient of B=0.0161; $\gamma$ is a specific gravity of the ink; and h is a maximum vertical head height, in meter, of the ink containing section relative to an ink supplying throat oriented in an arbitrary position.

In this invention, the ink cartridge satisfies $T \cdot N \cdot R \cdot B \geqq \gamma \cdot h$, where B is a coefficient of B=0.0161.

By setting $T \cdot N \cdot R \cdot B$ to be no less than $\gamma \cdot h$, an ink retaining power can be obtained that is no less than the maximum head pressure, irrespective of the orientation. Accordingly, this configuration prevents the problem of accidental ink leakage when the ink cartridge is inserted or detached.

Moreover, because a difference in the surface tension of the ink absorbed in the ink absorbing body is taken into account, this configuration more certainly prevents the problem of accidental ink leakage when the ink cartridge is inserted or detached.

Moreover, to solve the problems above, an ink cartridge of the present invention includes an ink containing section including an ink absorbing body made of a porous material for retaining ink, the ink cartridge satisfying:

$$C \cdot \{\mu \cdot L \cdot Q \cdot (N \cdot R)^2 / S\} \leqq T/D$$

where C is a coefficient of $C=1.88\times10^5$; $\mu$ is a viscosity of the ink in Pa·s; L is a height in meter of the ink absorbing body when the ink absorbing body is contained in a compressed state in the ink containing section; Q is a maximum amount of ink, expressed in cubic meter per second, ejected from a nozzle through which the ink containing section ejects ink; N is a cell density, expressed in the number of pores per inch, of the ink absorbing body before the ink absorbing body is contained in the ink containing section; R is a compressibility, which is a volume ratio of the ink absorbing body when the ink absorbing body is contained in a compressed state in the ink containing section to the ink absorbing body before the ink absorbing body is contained in the ink containing section; S is a cross-sectional area of the ink absorbing body, expressed in square meter, when the ink absorbing body is contained in a compressed state in the ink containing section; T is a surface tension of the ink, expressed in Newton per meter, absorbed in the ink absorbing body; and D is a diameter of the nozzle expressed in meter.

In this invention, the ink cartridge satisfies $C \cdot \{\mu \cdot L \cdot Q \cdot (N \cdot R)^2 / S\} \leqq T/D$ where C is a coefficient of $C=1.88\times10^5$.

When continuous ejection of the ink is performed, the negative pressure generated by the supply system needs to be no larger than an ink sucking pressure generated by a meniscus at the end of the nozzle. This is because the negative pressure generated by the supply system causes depletion of the ink. This leads to a problem that air is sucked into the nozzle as the liquid level of the ink retreats too much from the end of the nozzle. As a result, the ink cannot be supplied stably.

By satisfying $C \cdot \{\mu \cdot L \cdot Q \cdot (N \cdot R)^2 / S\} \leqq T/D$, the negative pressure generated by the supply system becomes smaller than the ink sucking pressure generated by the meniscus at the end of the nozzle. This makes it possible to stably supply the ink even when continuous ejection of the ink is performed.

Moreover, to solve the problems above, an ink cartridge of the present invention includes an ink containing section including an ink absorbing body made of a porous material for retaining ink, the ink cartridge satisfying:

$$(k/A) \cdot Q \cdot (N \cdot R)^2 \cdot (\mu \cdot L)/S \leqq 2000$$

where (k/A) is a coefficient of $(k/A)=7.52\times10^5$; Q is a maximum amount of ink, expressed in cubic meter per second, ejected from a nozzle through which the ink containing section ejects ink; N is a cell density, expressed in the number of pores per inch, of the ink absorbing body before the ink absorbing body is contained in the ink containing section; R is a compressibility, which is a volume ratio of the ink absorbing body when the ink absorbing body is contained in a compressed state in the ink containing section to the ink absorbing body before the ink absorbing body is contained in the ink containing section; $\mu$ is a viscosity of the ink in Pa·s; L is a height in meter of the ink absorbing body when the ink absorbing body is contained in a compressed state in the ink containing section; and S is a cross-sectional area of the ink absorbing body, expressed in square meter, when the ink absorbing body is contained in a compressed state in the ink containing section.

In this invention, the ink cartridge satisfies $(k/A)\cdot Q\cdot(N\cdot R)^2\cdot(\mu\cdot L)/S \leqq 2000$, where (k/A) is a coefficient of $(k/A)=7.52\times10^5$.

When continuous ejection of the ink is performed, the negative pressure generated by the supply system needs to be no larger than approximately 2.0 kPa, taking into consideration the safety factor. This is because the negative pressure generated by the supply system causes depletion of the ink. This leads to the problem that air is sucked into the nozzle as the liquid level of the ink retreats too much from the end of the nozzle. As a result, the ink cannot be supplied stably.

By satisfying $(k/A)\cdot Q\cdot(N\cdot R)^2\cdot(\mu\cdot L)/S \leqq 2000$, the negative pressure generated by the supply system becomes no larger than 2 kPa. This makes it possible to stably supply the ink even when continuous ejection of the ink is performed.

Moreover, to solve the problems above, an ink cartridge of the present invention includes an ink containing section including an ink absorbing body made of a porous material for retaining ink, the ink cartridge satisfying:

$$200 \leqq M \leqq 320$$

where M is an actual cell density expressed in the number of cells per inch.

In this invention, the ink cartridge satisfies $200 \leqq M \leqq 320$

In determining the ink retaining power of the ink cartridge, the height of the ink cartridge including the ink containing section, non-uniformity among cells of the foam material (expandable foam) used as the ink absorbing body, and vibration applied to the ink cartridge may be considered. This is because an insufficient ink retaining power causes the problem of ink leakage when the ink cartridge is inserted or detached.

For example, if the height of the ink cartridge is 34 mm, the ink retaining power needs to be 68 (=34×2) mm (0.68 kPa) by head, assuming a safety factor of 2. By setting the cell density M (cells/inch) to be no less than 200, an ink retaining power of no less than 86 mm (0.86 kPa) by head can be obtained. Accordingly, this configuration prevents the problem of accidental ink leakage when the ink cartridge is inserted or detached.

When continuous ejection of the ink is performed, the negative pressure generated by the supply system needs to be no larger than approximately 2.0 kPa, taking into consideration the safety factor. This is because the negative pressure generated by the supply system causes depletion of the ink. This leads to the problem that air is sucked into the nozzle as the liquid level of the ink retreats too much from the end of the nozzle. As a result, the ink cannot be supplied stably. By setting the cell density M (cells/inch) to be no larger than 320, the negative pressure generated by the supply system becomes no larger than 2 kPa. This makes it possible to stably supply the ink when continuous ejection of the ink is performed.

Conventional ink absorbing bodies are used only with N·R of less than 200. However, in the present invention, M=N·R can be set to equal to or more than 200, as long as M=N·R does not exceed 320. Therefore, an available range of ink absorbing bodies can be increased.

Moreover, to solve the problems above, an ink cartridge of the present invention includes an ink containing section including an ink absorbing body made of a porous material for retaining ink, the ink cartridge satisfying:

$$T\cdot M\cdot B \geqq 0.08$$

where T is a surface tension of the ink, expressed in Newton per meter, absorbed in the ink absorbing body; M is an actual cell density expressed in the number of cells per inch; and B is a coefficient of B=0.0161.

In this invention, the ink cartridge satisfies $T\cdot M\cdot B \geqq 0.08$, where B is a coefficient of B=0.0161.

By setting T·M·B to be no less than 0.08, an ink retaining power of no less than 0.8 kPa can be obtained. Accordingly, this configuration prevents the problem of accidental ink leakage when the ink cartridge is inserted or detached.

Moreover, because the difference in the surface tension of the ink absorbed in the ink absorbing body is taken into account, this configuration more certainly prevents the problem of accidental ink leakage when the ink cartridge is inserted or detached.

Moreover, to solve the problems above, an ink cartridge of the present invention includes an ink containing section including an ink absorbing body made of a porous material for retaining ink, the ink cartridge satisfying:

$$T\cdot M\cdot B \geqq \gamma\cdot h$$

where T is a surface tension of the ink, expressed in Newton per meter, absorbed in the ink absorbing body; M is an actual cell density expressed in the number of cells per inch; B is a coefficient of B=0.0161; γ is a specific gravity of the ink; and h is a maximum vertical head height, in meter, of the ink containing section relative to an ink supplying throat oriented in an arbitrary position.

In this invention, the ink cartridge satisfies $T\cdot M\cdot B \geqq \gamma\cdot h$, where B is a coefficient of B=0.0161.

By setting T·M·B to be no less than γ·h, an ink retaining power can be obtained that is no less than the maximum head pressure, irrespective of the orientation. Accordingly, this configuration prevents the problem of accidental ink leakage when the ink cartridge is inserted or detached.

Moreover, because the difference in the surface tension of the ink absorbed in the ink absorbing body is taken into account, this configuration more certainly prevents the problem of accidental ink leakage when the ink cartridge is inserted or detached.

Moreover, to solve the problems above, an ink cartridge of the present invention includes an ink containing section including an ink absorbing body made of a porous material for retaining ink, the ink cartridge satisfying:

$$Q\cdot M^2\cdot(\mu\cdot L)\cdot C/S \leqq T/D$$

where Q is a maximum amount of ink, expressed in cubic meter per second, ejected from a nozzle through which the ink containing section ejects ink; M is an actual cell density expressed in the number of cells per inch; $\mu$ is a viscosity of the ink in Pa·s; L is a height in meter of the ink absorbing body when the ink absorbing body is contained in a compressed state in the ink containing section; C is a coefficient of $C=1.88\times10^5$; S is a cross-sectional area of the ink absorbing body, expressed in square meter, when the ink absorbing body is contained in a compressed state in the ink containing section; T is a surface tension of the ink, expressed in Newton per meter, absorbed in the ink absorbing body; and D is a diameter of the nozzle expressed in meter.

In this invention, the ink cartridge satisfies $Q\cdot M^2\cdot(\mu\cdot L)\cdot C/S \leqq T/D$, where C is a coefficient of $C=1.88\times10^5$.

When continuous ejection of the ink is performed, the negative pressure generated by the supply system needs to be no larger than the ink sucking pressure generated by the meniscus at the end of the nozzle. This is because the negative pressure generated by the supply system causes depletion of the ink. This leads to the problem that air is sucked into the nozzle as the liquid level of the ink retreats too much from the end of the nozzle. As a result, the ink cannot be supplied stably.

By satisfying $Q \cdot M^2 \cdot (\mu \cdot L) \cdot C/S \leqq T/D$, the negative pressure generated by the supply system becomes no larger than the ink sucking pressure generated by the meniscus at the end of the nozzle. This makes it possible to stably supply the ink even when continuous ejection of the ink is performed.

Moreover, to solve the problems above, an ink cartridge of the present invention includes an ink containing section including an ink absorbing body made of porous body for retaining ink, the ink cartridge satisfying:

$$(k/A) \cdot Q \cdot M^2 \cdot (\mu \cdot L)/S \leqq 2000$$

where (k/A) is a coefficient of $(k/A)=7.52\times10^5$; Q is a maximum amount of ink, expressed in cubic meter per second, ejected from a nozzle through which the ink containing section ejects ink; M is an actual cell density expressed in the number of cells per inch; $\mu$ is a viscosity of the ink in Pa·s; L is a height in meter of the ink absorbing body when the ink absorbing body is contained in a compressed state in the ink containing section; and S is a cross-sectional area of the ink absorbing body, expressed in square meter, when the ink absorbing body is contained in a compressed state in the ink containing section.

In this invention, the ink cartridge satisfies $(k/A) \cdot Q \cdot M^2 \cdot (\mu \cdot L)/S \leqq 2000$, where (k/A) is a coefficient of $(k/A)=7.52\times10^5$.

When continuous ejection of the ink is performed, the negative pressure generated by the supply system needs to be no larger than approximately 2.0 kPa, taking into consideration the safety factor. This is because the negative pressure generated by the supply system causes depletion of the ink. This leads to a problem that air is sucked into the nozzle as the liquid level of the ink retreats too much from the end of the nozzle. As a result, the ink cannot be supplied stably.

By satisfying $(k/A) \cdot Q \cdot M^2 \cdot (\mu \cdot L)/S \leqq 2000$, the negative pressure generated by the supply system becomes no larger than 2 kPa. This makes it possible to stably supply the ink even when continuous ejection of the ink is performed.

Moreover, to solve the problems above, an ink cartridge of the present invention includes an ink containing section including an ink absorbing body made of a porous material for retaining ink, the ink cartridge satisfying:

$$\{T \cdot S/(C \cdot D \cdot \mu \cdot L \cdot Q)\}^{0.5} \geqq (N \cdot R) \geqq \gamma \cdot h/(T \cdot B)$$

where T is a surface tension of the ink, expressed in Newton per meter, absorbed in the ink absorbing body; S is a cross-sectional area of the ink absorbing body, expressed in square meter, when the ink absorbing body is contained in a compression state in the ink containing section; C is a coefficient of $C=1.88\times10^5$; D is a diameter of a nozzle, expressed in meter, through which the ink containing section ejects ink; $\mu$ is a viscosity of the ink in Pa·s; L is a height in meter of the ink absorbing body when the ink absorbing body is contained in a compressed state in the ink containing section; Q is a maximum amount of ink, expressed in cubic meter per second, ejected from the nozzle; N is a cell density, expressed in the number of pores per inch, of the ink absorbing body before the ink absorbing body is contained in the ink containing section; R is a compressibility, which is a volume ratio of the ink absorbing body when the ink absorbing body is contained in a compressed state in the ink containing section to the ink absorbing body before the ink absorbing body is contained in the ink containing section; $\gamma$ is a specific gravity of the ink; and h is a maximum vertical head height, in meter, of the ink containing section relative to an ink supplying throat oriented in an arbitrary position; and B is a coefficient of B=0.0161.

In this invention, the ink cartridge satisfies $\{T \cdot S/(C \cdot D \cdot \mu \cdot L \cdot Q)\}^{0.5} \geqq (N \cdot R) \geqq \gamma \cdot h/(T \cdot B)$, where C is a coefficient of $C=1.88\times10^5$, and B is a coefficient of B=0.0161.

By setting $T \cdot N \cdot R \cdot B$ to be no less than $\gamma \cdot h$, an ink retaining power can be obtained that is no less than the maximum head pressure, irrespective of the orientation, taking into account the difference in surface tension T of the ink absorbed in the ink absorbing body. Accordingly, this configuration more certainly prevents the problem of accidental ink leakage when the ink cartridge is inserted or detached. In addition, the negative pressure generated by the supply system becomes no larger than the ink sucking pressure generated by the meniscus at the end of the nozzle, when continuous ejection of the ink is performed. This ensures that an ink ejecting operation is properly carried out, without the problem that air is sucked into the nozzle as the liquid level of the ink retreats too much from the end of the nozzle due to depletion of the ink caused by the negative pressure generated by the supply system.

Moreover, to solve the problems above, an ink cartridge of the present invention includes an ink containing section including an ink absorbing body made of a porous material for retaining ink, the ink cartridge satisfying:

$$\{T \cdot S/(C \cdot D \cdot \mu \cdot L \cdot Q)\}^{0.5} \geqq M \geqq \gamma \cdot h/(T \cdot B)$$

where T is a surface tension of the ink, expressed in Newton per meter, absorbed in the ink absorbing body; S is a cross-sectional area of the ink absorbing body, expressed in square meter, when the ink absorbing body is contained in a compressed state in the ink containing section; C is a coefficient of $C=1.88\times10^5$; D is a diameter of a nozzle, expressed in meter, through which the ink containing section ejects ink; $\mu$ is a viscosity of the ink in Pa·s; L is a height in meter of the ink absorbing body when the ink absorbing body is contained in a compressed state in the ink containing section; Q is a maximum amount of ink, expressed in cubic meter per second, ejected from the nozzle; M is an actual cell density expressed in the number of cells per inch; $\gamma$ is a specific gravity of the ink; and h is a maximum vertical head height, in meter, of the ink containing section relative to an ink supplying throat oriented in an arbitrary position; and B is a coefficient of B=0.0161.

In this invention, the ink cartridge satisfies $\{T \cdot S/(C \cdot D \cdot \mu \cdot L \cdot Q)\}^{0.5} \geqq M \geqq \gamma \cdot h/(T \cdot B)$, where C is a coefficient of $C=1.88\times10^5$, and B is a coefficient of B=0.0161.

By setting $T \cdot M \cdot B$ to be no less than $\gamma \cdot h$, an ink retaining power can be obtained that is no less than the maximum head pressure, irrespective of the orientation, taking into account the difference in surface tension T of the ink absorbed in the ink absorbing body. Accordingly, this configuration more certainly prevents the problem of accidental ink leakage when the ink cartridge is inserted or detached. In addition, the negative pressure generated by the supply system becomes no larger than the ink sucking pressure generated by the meniscus at the end of the nozzle, when continuous ejection of the ink is performed. This ensures that the ink ejecting operation is properly carried out, without the problem that air is sucked into the nozzle as the liquid level of the ink retreats too much from the end of the nozzle due to depletion of the ink caused by the negative pressure generated by the supply system.

To solve the problems above, an image forming apparatus of the present invention includes any one of the ink cartridges described above.

According to this invention, an image forming apparatus such as an ink jet recording apparatus includes any one of the ink cartridges described above.

Therefore, it is possible to provide an image forming apparatus capable of increasing an available range of design indices for the ink absorbing body.

Moreover, it is possible to provide an image forming apparatus that provides design indices for the ink absorbing body in accordance with properties of the ink, so as to prevent problems such as depletion of the ink caused when continuous ejection is performed, and ink leakage caused when the ink cartridge is inserted or detached.

For a fuller understanding of the nature and advantages of the invention, reference should be made to the ensuring detailed description taken in conjunction with the accompanying drawings.

BRIEF DESCRIPTION OF THE DRAWINGS

In the drawings:

FIG. 2 is a perspective view illustrating an overall structure of the ink jet recording apparatus, with a portion of the ink jet recording apparatus seen through;

FIG. 4(*b*) is a cross-sectional view illustrating a state in which an ink supplying path is detached from the ink cartridge; and FIG. 4(*c*) is a cross-sectional view illustrating a structure of detecting electrodes;

DESCRIPTION OF THE EMBODIMENTS

With reference to FIGS. 1 to 18, the following describes one embodiment of the present invention.

Figure 2:
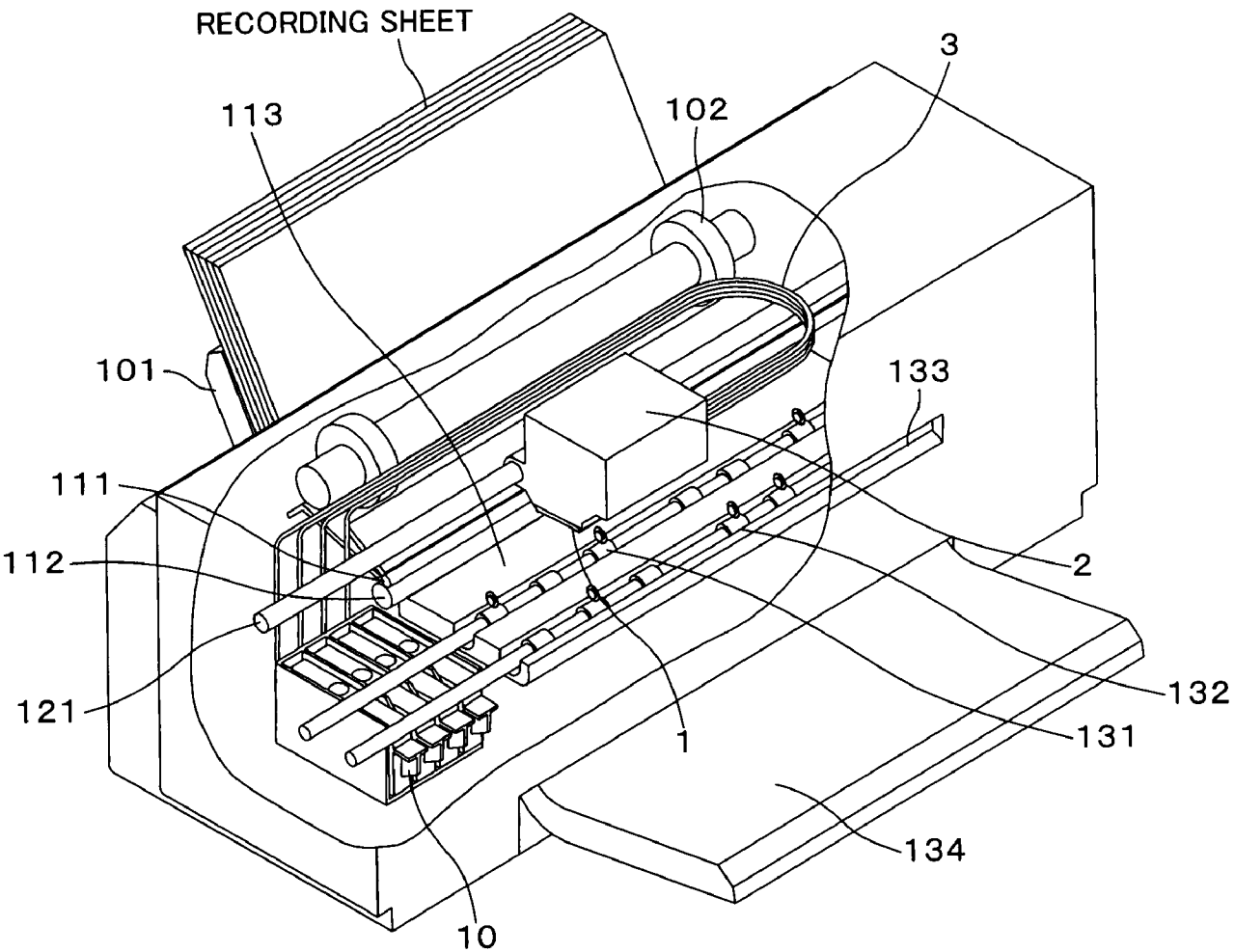

As shown in FIG. 2, an ink jet recording apparatus of the present embodiment functions as an image forming apparatus and includes a feeding section, a separating section, a conveying section, a printing section, and an ejecting section.

The feeding section, which includes a feeding tray 101 and a pickup roller 102, feeds recording sheets in printing. When printing is not performed, the feeding section functions as a sheet storage.

The separating section supplies, sheet-by-sheet to the printing section, the sheets fed by the feeding section. The separating section includes a feeding roller and a separator (neither is shown). The separating apparatus is so set that the friction between a sheet and a pad section, which is a point of contact with the sheet, is larger than the friction between the sheets. The feeding roller is so set that the friction between the feeding roller and the sheet is larger than the friction between the pad and the sheet or between the sheets. As a result, even if two sheets are sent to the separating section, it is possible to separate the sheets and send only the upper sheet to the conveying section.

The conveying section conveys, to the printing section, the sheets supplied sheet-by-sheet by the separating section. The conveying section includes a guiding board (not shown) and a pair of rollers such as a conveying press roller 111 and a conveying roller 112. The roller pair sets the sheet in position when the sheet is being conveyed to the space between a print head 1 and a platen 113, so that the ink supplied by the print head 1 is sprayed onto appropriate positions of the sheet.

The printing section performs printing on the sheet supplied by the roller pair of the conveying section. The printing section includes the print head 1, a carriage 2 in which the printer head 1 is installed, a guiding bar 121 for guiding the carriage 2, an ink cartridge 20 for supplying ink to the print head 1, and a platen 113 on which the sheet is placed during printing. The print head 1, the ink cartridge 20, and an ink supplying path 3 constitute an ink supplying unit 10, which is described later.

The ejecting section ejects the sheet out of the ink jet recording apparatus after printing. The ejecting section includes ejecting rollers 131 and 132 and an ejection tray 134.

The ink jet recording apparatus of the foregoing structure operates as follows to perform printing.

First, the ink jet recording apparatus receives a request for printing from a computer or like apparatus (not shown), the printing request being made according to image information. After receiving the request for printing, the ink jet recording apparatus sends sheets on the feeding tray 101 from the feeding section, using the pickup roller 102.

Next, the sheet that has been sent is conveyed by the feeding roller through the separating section, and is sent to the conveying section. The conveying section conveys the sheet to the space between the print head 1 and the platen 113, using the conveying press roller 111 and the conveying roller 112 making up the roller pair.

In the printing section, ink is sprayed from spraying nozzles of the print head 1 onto the sheet on the platen 113, in accordance with the image information. At this time, the sheet is temporarily stopped on the platen 113. While the ink is being sprayed, the carriage 2 makes a scan in a main-scanning direction by being guided with the guiding bar 121.

After that, the sheet is moved by a certain distance in a sub-scanning direction on the platen 113. These operations are consecutively carried out in the printing section in accordance with the image information, until printing is finished with respect to the entire sheet.

The printed sheet passes an ink drying section, and is ejected by the ejection rollers 131 and 132 to the ejection tray 134 via a sheet ejecting opening 133. Then, the sheet is supplied to a user as a printed document.

Figure 3:
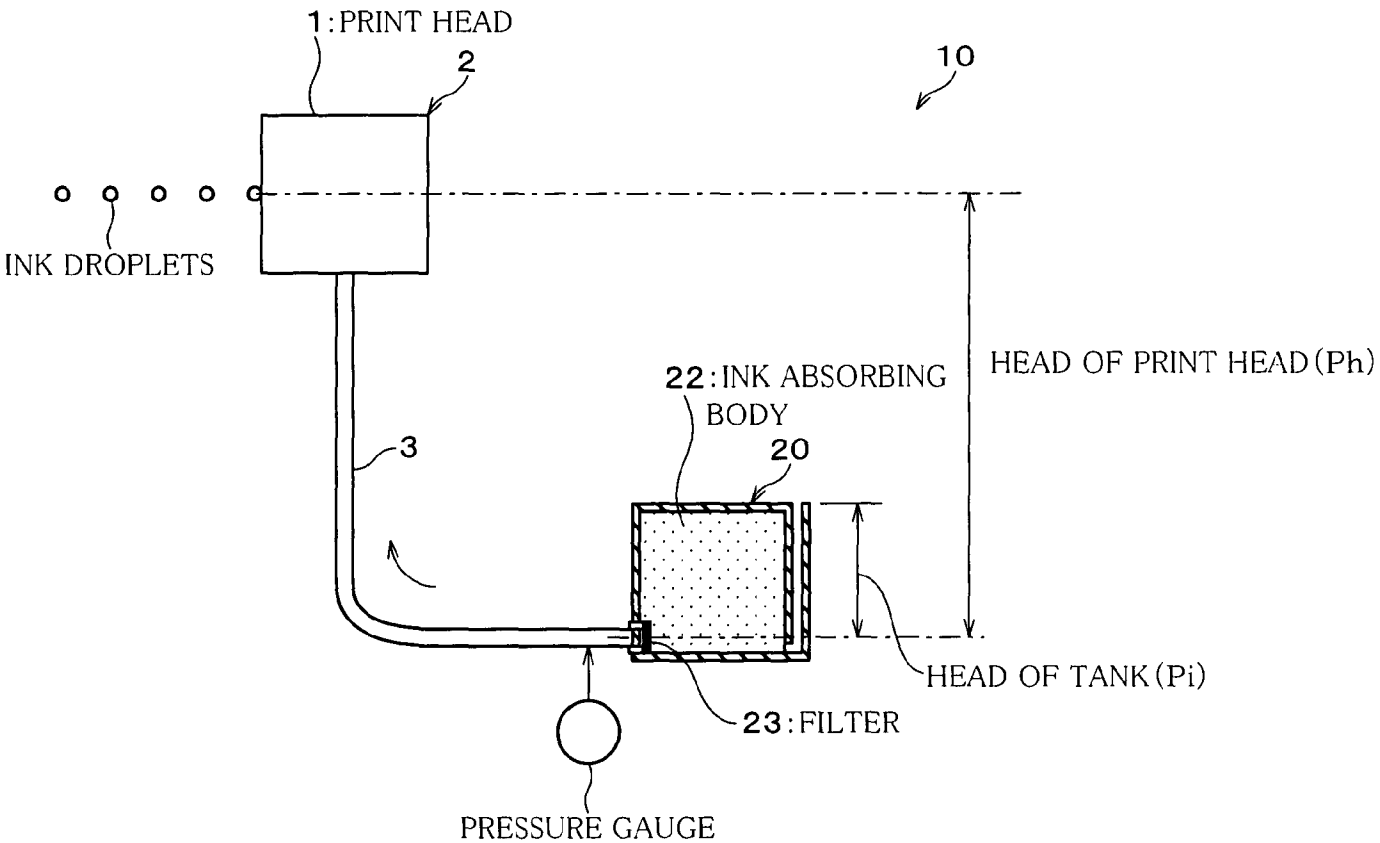
FIG. 3 is a block diagram illustrating a schematic structure of an ink supplying apparatus for the inkjet recording apparatus.
Figure 4:
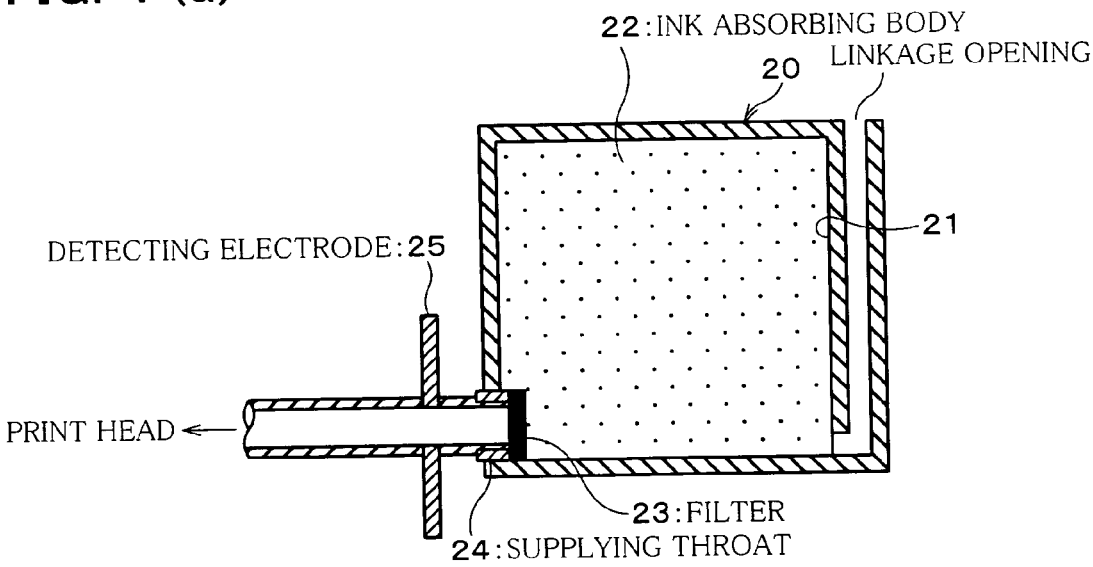
FIG. 4(*a*) is a cross-sectional view illustrating a structure of an ink cartridge.
Figure 4:
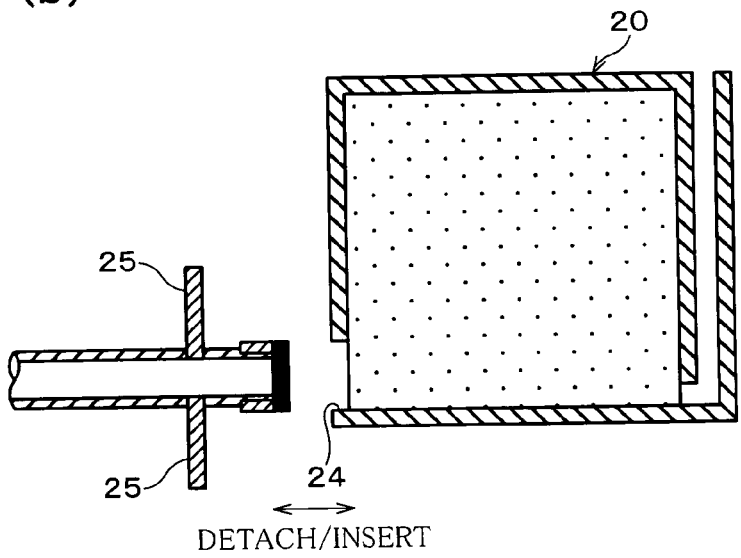
Figure 4:
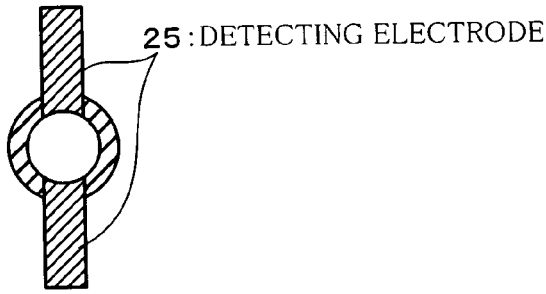
Figure 5:
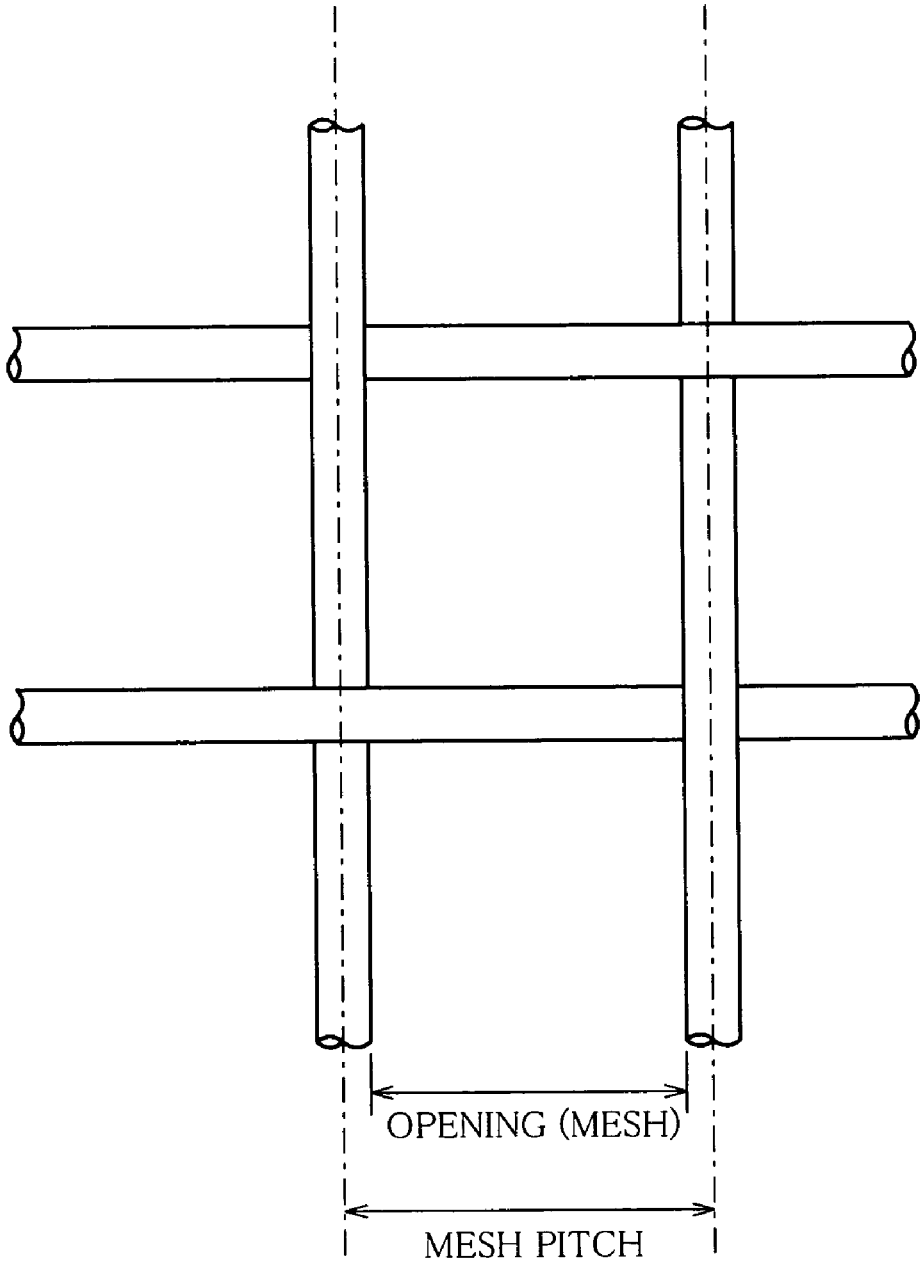
FIG. 5 is a front view illustrating a structure of a filter of the ink supplying apparatus.

With reference to FIGS. 3 to 5, the ink supplying unit 10 of the ink jet recording apparatus is described below in detail.

As shown in FIG. 3, the ink supplying unit 10 includes the print head 1, the ink cartridge 20, and the ink supplying path 3, as described above.

As shown in FIGS. 4(*a*) and 4(*b*), the ink cartridge 20 generally has an ink tank 21, provided as an ink containing section inside the ink cartridge 20 to store ink. In the ink cartridge 20 of the present embodiment, the ink tank 21 includes an ink absorbing body 22, which is, for example, a porous material made of polyurethane resin for retaining ink.

The ink tank 21 has, along a bottom surface thereof for example, the ink supplying path 3 realized by an ink supplying tube for supplying ink to the print head 1.

At an end of the ink supplying path 3, an ink supplying throat 24 having a filter 23 is provided. The ink supplying throat 24 is connected by insertion to the ink tank 21. Therefore, the ink supplying throat 24 is inside the ink tank 21.

As shown in FIGS. 4(*a*), 4(*b*), and 4(*c*), the ink supplying path 3 outside the ink tank 21 has a pair of detecting electrodes 25 provided to sandwich the ink supplying path 3.

The print head 1 is adapted to eject 0.49 cc of ink per minute, for example. The pressure exerted within the ink supplying path 3 can be measured by a pressure gauge. The print head 1 and the ink cartridge 20 are so positioned that the head (Ph) of the print head 1 is 50 mm, and the head (Ph) of the ink tank 21 is 30 mm, for example.

The filter 23 is made of, for example, stainless steel, and is prepared by braiding bands of stainless steel as shown in FIG. 5. However, the filter 23 may be prepared in other ways. For example, the filter 23 may be prepared by reticulating a plate by etching.

As shown in FIGS. 4(*a*), 4(*b*), and 4(*c*), in the ink cartridge 20, a remaining amount of ink (depletion of ink) is detected by utilizing the fact that no current flows across the detecting electrodes 25 when ink has been pushed out from the detecting electrodes 25 by the air entrained into the ink supplying path 3 through the filter 23, that is, when there is no ink between the detecting electrodes 25.

Figure 6:
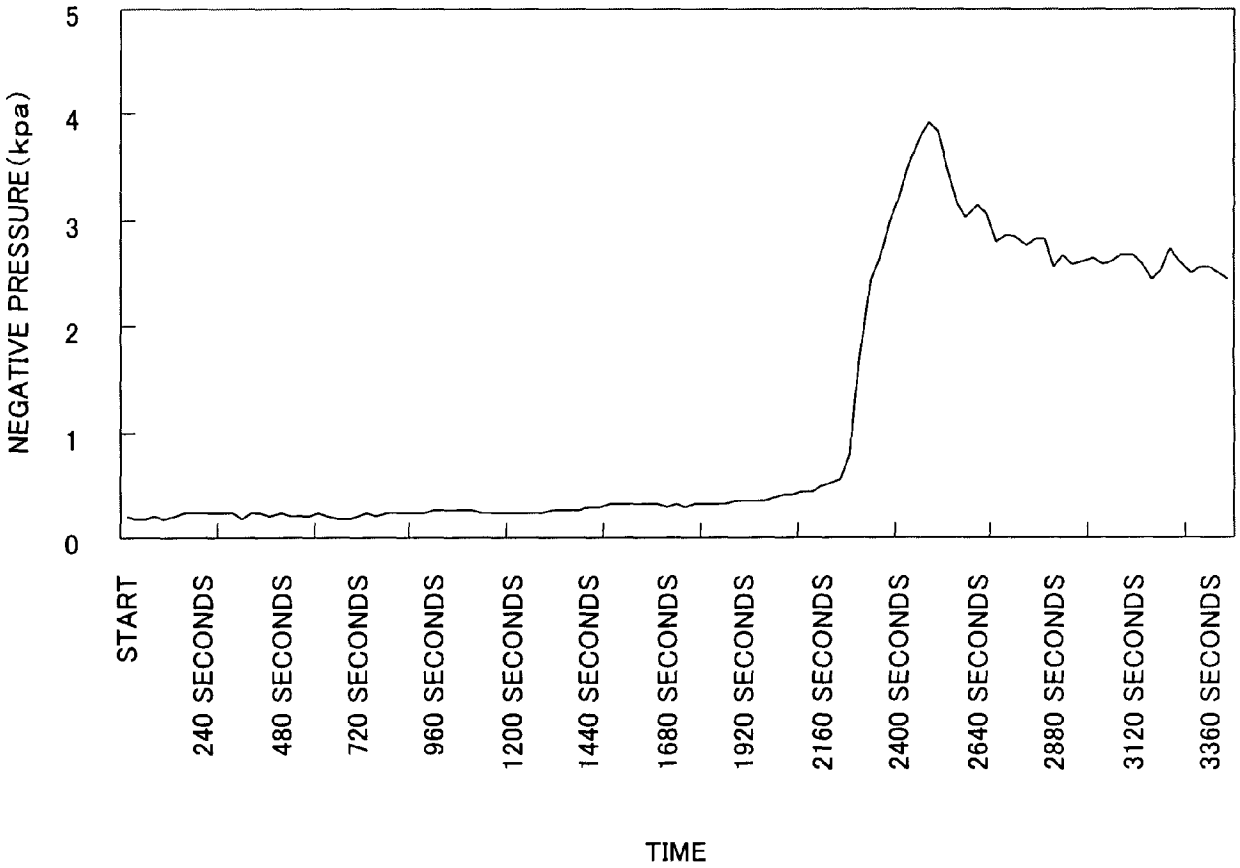
FIG. 6 is a graph showing a relationship between time and the negative pressure generated by the ink cartridge when ink is continuously ejected from the ink cartridge fully charged with the ink.
Figure 7:
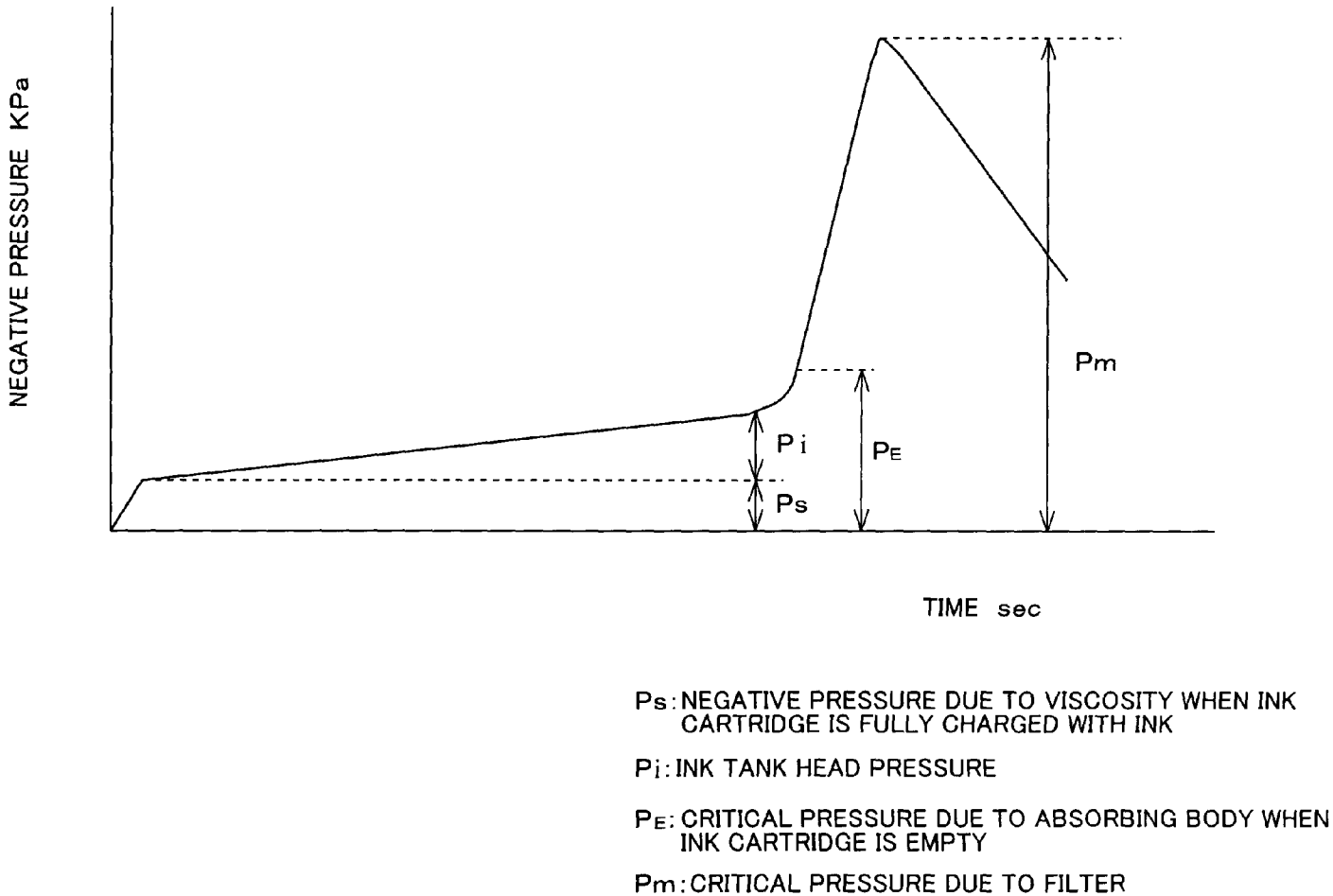
FIG. 7 is a schematic representation of the graph shown in FIG. 6.

The following describes how a remaining amount of ink is detected this way, with reference to FIGS. 6 and 7. FIGS. 6 and 7 are graphs showing a relationship between applied pressure within the ink supplying path 3 and elapsed time. FIG. 6 is a simplified version of the explanatory diagram of FIG. 7.

First, when the print head 1 is driven, that is, when a negative pressure is created in the ink supplying path 3 to consume the ink inside the ink tank 21, the negative pressure gradually increases as the amount of ink consumed increases, as shown in FIGS. 6 and 7. When the remaining amount of ink becomes low, the negative pressure increases abruptly at a certain moment. This can be explained as follows. When the negative pressure becomes too large by a large sucking force exerted on the ink supplying tube 3, the value of the negative pressure exceeds that of the ink supplying pressure exerted within the ink absorbing body 22, with the result that a film of ink in the meshes (cells) of the filter 23 is broken. The broken ink film sets off an abrupt increase in negative pressure.

Figure 8:
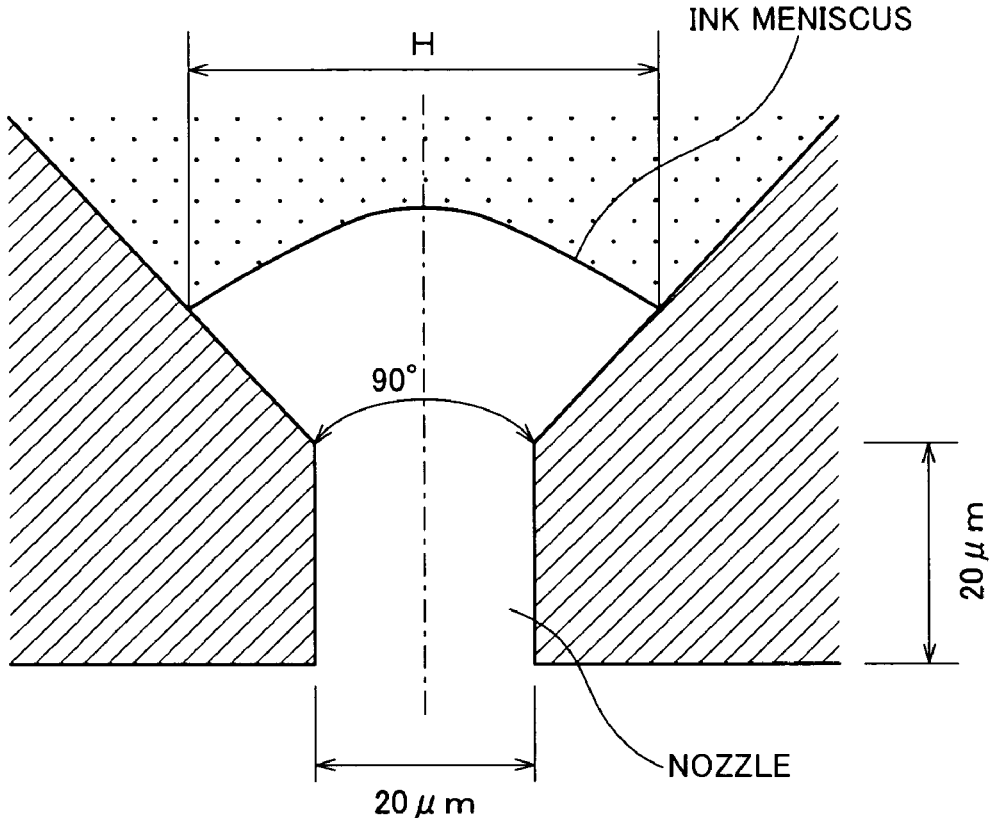
FIG. 8 is a cross-sectional view illustrating an enlarged view of a structure of an end portion of a supplying throat.

That is, the increase in negative pressure is caused by the following sequence of events. The negative pressure first increases to the critical pressure according to the cell diameter by the surface tension of the ink. Then, the negative pressure abruptly increases to the critical pressure determined by the ink meniscus formed in the meshes of the filter 23, as shown in FIG. 8, each mesh being smaller than the cell diameter. When the suction pressure from the print head 1 exceeds the critical pressure, the surface of the ink meniscus formed in the meshes of the filter 23 is broken, with the result that the negative pressure is increased.

Next, described below in detail is how to optimize the ink absorbing body 22 of the ink cartridge 20.

As shown in FIGS. 4(*a*), 4(*b*), and 4(*c*), in the present embodiment, provided is the ink cartridge 20 including the ink tank 21 in which a foam material is contained as the ink absorbing body 22. The porous material of the foam material is soaked with ink. The foam material is contained in a compressed state in the ink tank 21.

The ink retained in the porous material is ejected by a capillary action from inside the ink cartridge 20 to the print head 1 via the ink supplying throat 24 (nozzle) of the ink cartridge 20.

Incidentally, depending of the ink retaining power of the porous material, there are cases where ink is depleted during continuous ejection of the ink, or ink leakage is caused when the ink cartridge 20 is inserted or detached.

These problems can be solved by determining design indices for the ink absorbing body 22 in accordance with properties of the ink. In the present embodiment, an experiment was conducted using ink, the foam material, and the ink cartridge 20 to measure an stable negative pressure P in the ink cartridge 20 and to evaluate design indices. Table 1 shows the result of experiment. The ink, the foam material, and the ink cartridge 20 were used under the following conditions.

Surface tension of the ink: T=0.03 (N/m) (30 dyn/cm)

Viscosity of the ink: $\mu$=0.07 (Pa·s) (7 cp)

Composition of the ink: $H_2O$, pigment, and polyethyleneglycol

Cell density of the foam material: N=40 (cells/inch)=1.57 (cells/mm);

Material of the foam material: polyurethane;

Outer dimensions of the foam material when contained in the ink cartridge (width×depth×height):

$$W \times D \times L = 0.015 \times 0.074 \times 0.030 (m)$$

Inner dimensions of the ink cartridge (width×depth×height):

$$W \times D \times L = 0.015 \times 0.074 \times 0.030 (m).$$

(116) The headings used in Table 1 are as follows.

Compressibility R: The volume ratio of the foam material after it is contained in a compressed state in the ink containing section to the foam material before it is contained in the ink containing section Cell density N (cells/inch): The cell density of the foam material of the ink absorbing body 22 before the foam material is contained in the ink cartridge Actual cell density M of the foam material in a compressed state (cells/inch): The actual cell density of the ink absorbing body 22 contained in a compressed state in the ink cartridge;

Flaw rate Q ($m^3/s$): The flow rate of the ink

Efficiency (%): (a net amount of flow from the ink cartridge)÷(an amount of ink filled);

Maximum ink stable negative pressure Ph (Pa):

The stable negative pressure when the ink cartridge is fully charged with the ink (i.e. when the ink cartridge is full and when the ink is ejected at a certain flow rate.

Minimum ink stable negative pressure PL (Pa):

The stable negative pressure in the ink cartridge measured when the ink cartridge is charged at the minimum level (i.e. immediately before the ink in the ink cartridge is depleted) and when the ink is ejected at a certain flow rate.

Here, because the height of the ink cartridge 20 is 34 mm, a required ink retaining power is 68 (=34×2) mm by head (0.67 kPa), assuming a safety factor of 2.

The ink retaining power is the capillary pressure generated by the surface tension T. By setting the actual cell density M (cells/inch) to be no less than 200, the minimum ink stable negative pressure PL can produce an ink retaining power of no less than 0.86 kPa (89 mm by head). Accordingly, it is possible to prevent the problem of accidental ink leakage when the ink cartridge is inserted or detached.

When continuous ejection of the ink is performed, the negative pressure generated by the supply system needs to be no larger than approximately 2.0 kPa, considering the safety factor. If not, the negative pressure generated by the supply system causes depletion of the ink. This leads to a problem that air is sucked into the nozzle as the liquid surface of the ink retreats too much from the end of the nozzle. As a result, the ink cannot be supplied stably.

By setting the actual cell density M (cells/inch) to be no larger than 320, the negative pressure generated by the supply system becomes no larger than 1.5 kPa. This makes it possible to stably supply the ink with a margin when continuous ejection of the ink is performed.

Figure 1:
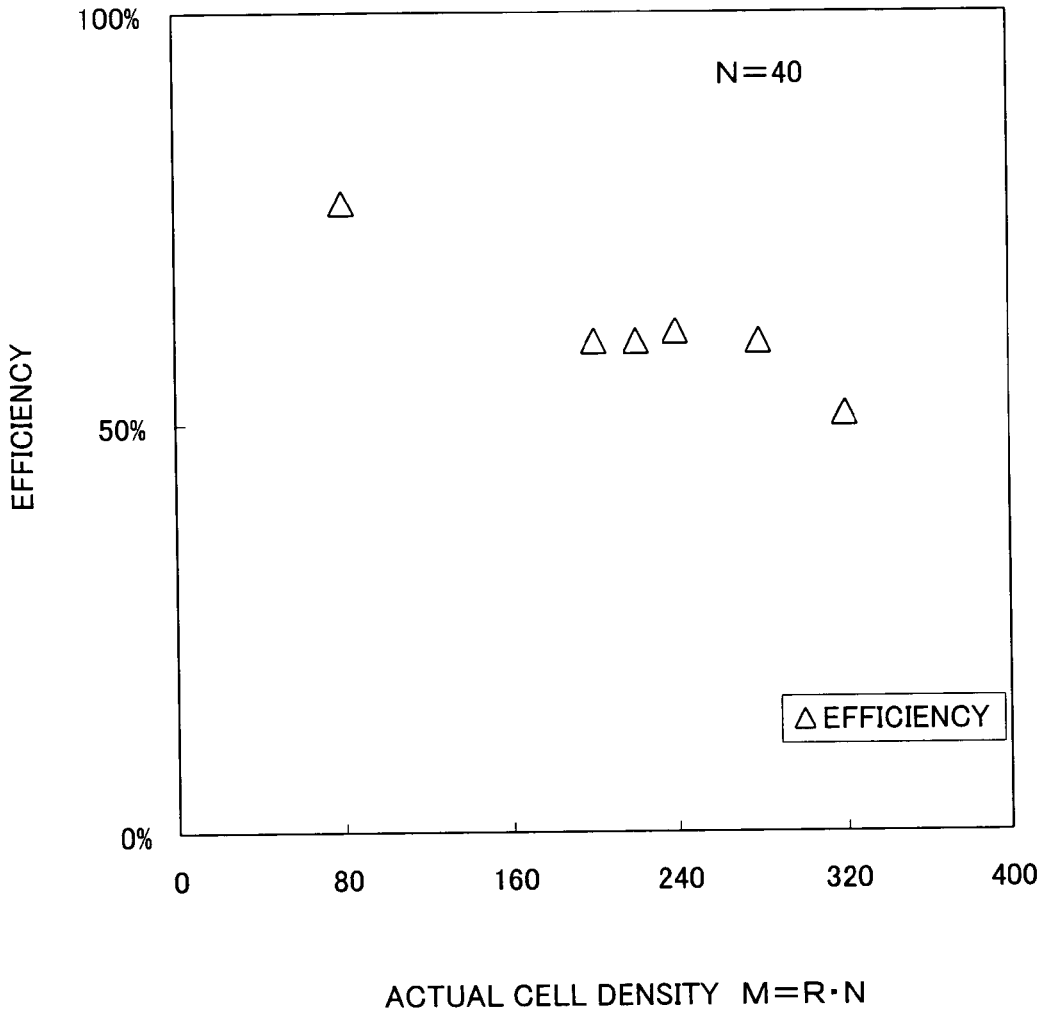
FIG. 1 is a graph according to one embodiment of an ink jet recording apparatus of the present invention, showing a relationship between efficiency and actual cell density M=N·R (cells/inch)
Figure 9:
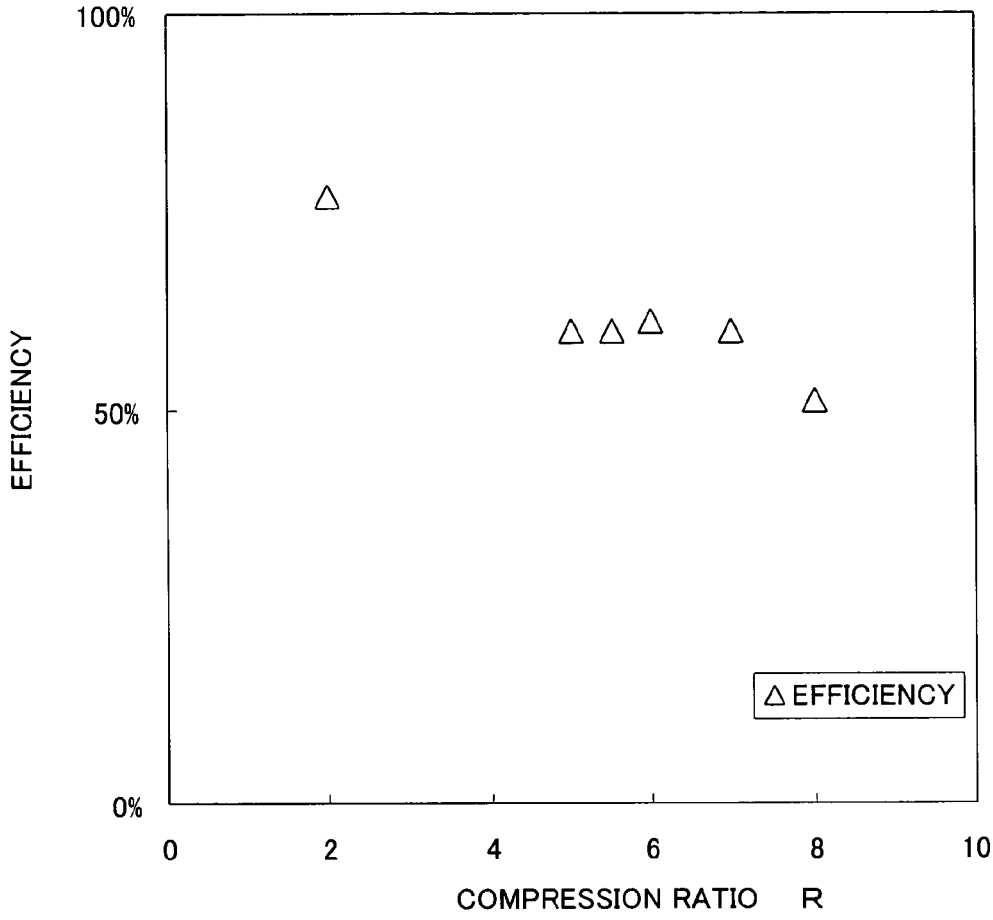
FIG. 9 is a graph showing a relationship between efficiency and cell density N (cells/inch)

Assuming that the efficiency is the ratio of (i) a volume of the ink that can be actually used to (ii) an internal volume of the ink cartridge 20, the efficiency decreases as R increases, as shown in FIG. 9, and starts to abruptly decrease when the actual cell density M (cells/inch) is 320, as shown in FIG. 1. Therefore, the actual cell density M (cells/inch) of no larger than 320 is one condition for efficiently utilizing the volume of the ink cartridge 20.

TABLE 1

| C | ACTUAL DENSITY M | MEASURED FLOW RATE | E | MSNP (kPa) Max. | MSNP (kPa) Mini. | RATIO AT START POINT | | | RATIO AT END POINT | | |
|---|---|---|---|---|---|---|---|---|---|---|---|
| R | N*R | Q ($nm^3/s$) | η0 (%) | Ph | PL | Rs | R2 | Rs/R2 | Re | R1 | Re/R1 |
| 2 | 80 | 8.17 | 77% | 0.07 | 0.46 | 0.11 | 0.13 | 0.85 | 0.46 | 0.36 | 1.28 |
| 5 | 200 | 8.17 | 60% | 0.62 | 0.86 | 1.00 | 0.83 | 1.21 | 0.87 | 0.91 | 0.96 |
| 5.5 | 220 | 8.17 | 60% | 0.62 | 0.99 | 1.00 | 1.00 | 1.00 | 1.00 | 1.00 | 1.00 |
| 6 | 240 | 8.17 | 61% | 0.73 | 1.16 | 1.18 | 1.19 | 0.99 | 1.17 | 1.09 | 1.07 |
| 7 | 280 | 8.17 | 60% | 0.91 | 1.29 | 1.47 | 1.62 | 0.91 | 1.30 | 1.27 | 1.02 |
| 8 | 320 | 8.17 | 51% | 1.30 | 1.50 | 2.10 | 2.12 | 0.99 | 1.52 | 1.45 | 1.04 |

C: COMPRESSIBILITY;
E: EFFICIENCY;
MSNP: MEASURED STABLE NEGATIVE PRESSURE

After the measured values of generated negative pressure were analyzed according to hydrodynamic theories, it was found that the maximum ink stable negative pressure Ph (Pa) depended on a pressure loss in the flow path due to the viscosity of the ink, and that the minimum ink stable negative pressure PL (Pa) depended on the critical pressure of the capillary tube due to the surface tension T of the ink. This analysis is more specifically described later.

In determining ink retaining power of the ink cartridge, a height of the ink cartridge 20, variances among the foam cells, and the vibration applied to the ink cartridge 20 may be considered. This is because poor ink retaining power causes the problem of accidental ink leakage when the ink cartridge is inserted or detached in a fully charged state.

Although the above values are theoretical values, it was confirmed that measured values also met these conditions. Specifically, Table 1 indicates that the minimum ink stable negative pressure PL, which is a measured negative pressure, is no less than 0.86 kPa when the actual cell density M=N·R (cells/inch) is 200, and that the maximum ink stable negative pressure Ph, which is a measured negative pressure, is no larger than 1.50 kPa when the actual cell density M=N·R (cells/inch) is 320. The minimum ink stable negative pressure PL, which is a measured negative pressure, denotes how much negative pressure the meniscus can resist.

Next, the minimum ink stable negative pressure PL and the maximum ink stable negative pressure Ph are discussed. The maximum ink stable negative pressure Ph denotes a negative pressure when the ink is flowing.

First, the values of Rs under "RATIO AT START POINT" in Table 1 are normalized values of the respective maximum ink stable negative pressures Ph with respect to the maximum ink stable negative pressure of Ph=0.62 kPa for the compressibility of R=5.5 and the flow rate of Q=8.17 $nm^3/s$ (0.49 cc/min). R2 represents values of compressibility $R^2$ normalized with respect to the compressibility of R=5.5.

Meanwhile, the values of Re under "RATIO AT END POINT" in Table 1 are values of the respective minimum ink stable negative pressures PL normalized with respect to the minimum ink stable negative pressure of PL=0.99 kPa for the compressibility of R=5.5 and the flow rate Q=8.17 $nm^3/s$ (0.49 cc/min). R1 represents values of compressibility R normalized with respect to the compressibility of R=5.5.

Here, according to Table 1, Rs/R2 calculated at a start point and Re/R1 calculated at an end point are both substantially equal to 1. Therefore, it is found that the maximum ink stable negative pressure Ph is proportional to the square of compressibility R, and the minimum ink stable negative pressure PL is proportional to compressibility R.

Based on these findings and in order to obtain more specific design indices for the ink and the foam material, the following theorization was made and the result was analyzed.

Figure 10:
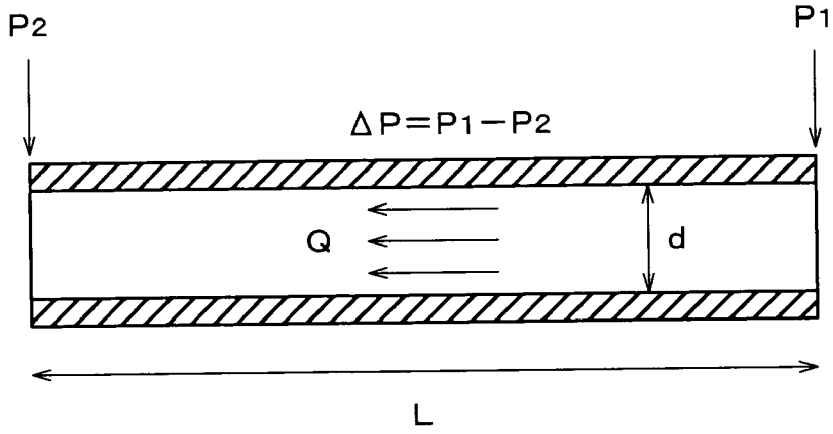
FIG. 10 is a schematic diagram showing a relationship between flow rate and pressure difference within a conduit, assuming that each cell of a foam material of the ink cartridge is a round conduit.

When the ink cartridge 20 is fully charged with the ink (i.e. when the ink cartridge 20 is full), it can be assumed that each call of the foam material is a round conduit, and that the liquid (ink in the present invention) in the conduit is flown by a pressure difference within the conduit. As shown in FIG. 10, the flow rate Q ($m^3/s$) of a flow in the round conduit can be defined as:

$$Qi=\Delta P\cdot\pi\cdot d^4/(128\cdot\mu\cdot L) \quad (1)$$

where ΔP is the pressure loss (Pa) in the conduit, d is the diameter (m) of the conduit, $\mu$ is the viscosity (Pa·s), and L is the length (m) of the conduit.

Since the actual cell density of the foam material in a compressed state is M=N·R (cells/inch), the cell diameter d(m) of the foam material in a compressed state is given by:

$$d=0.0254/(N\cdot R) \quad (2)$$

Figure 11:
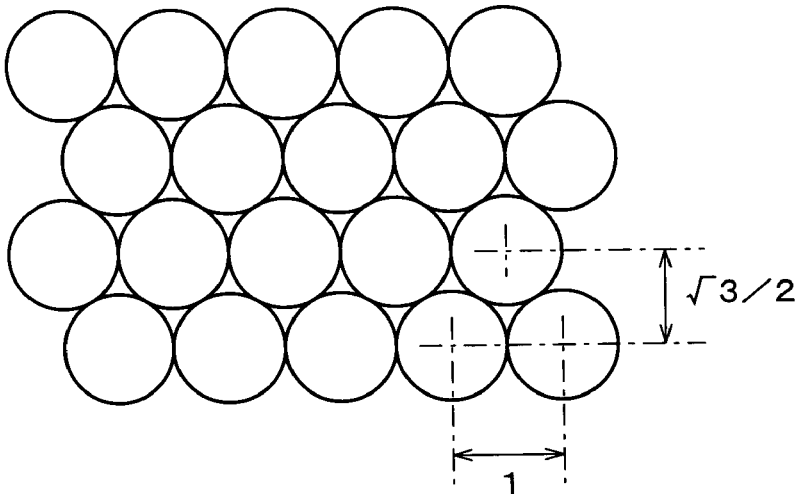
FIG. 11 is a schematic diagram illustrating cells closely packed together.

(131) Because the foam material is contained in the ink cartridge 20 in the compressed state, the cells of the foam material are assumed to be most closely packed, as shown in FIG. 11. Therefore, the total number of cells Nd (cells) at a lower end of the form in a compressed state is given by:

$$Nd=(2/\sqrt{3})\cdot S/(d^2) \quad (3)$$

where S is the cross-sectional area (W×D) of the foam material.

It follows from this that, when the flow path is assumed to be a column of a constant diameter in Expression (3), the total flow rate Qt ($m^3/s$) is given as follows according to Expressions (1), (2), and (3).

$$\begin{aligned} Qt &= Qi\cdot Nd \quad (4)\\ &= \{\Delta P\cdot\pi\cdot d^4/(128\cdot\mu\cdot L)\}\cdot\{(2/\sqrt{3})\cdot S/(d^2)\}\\ &= A\cdot\Delta PS/\{\mu\cdot L\cdot(N\cdot R)^2\} \end{aligned}$$

where A is a coefficient of $A=1.83\times10^{-5}$.

It can be seen from this that the total flow rate Qt is inversely proportional to the square of the actual cell density M=N·R (cells/inch) of the foam material in a compressed state.

Table 2 shows values of the total flow rate Qt, which are theoretical values calculated in accordance with Expression (4), assuming the column-shaped flow path shown in FIG. 10.

TABLE 2

C: COMPRESSIBILITY;

| C R | AVERAGE CELL DIAMETER d (mm) | MSNP Ph (kPa) | FLOW RATE/ NUMBER Qi ($pm^3/s$) | NUMBER OF FLOW PATHS Nd (number) | TOTAL FLOW RATE Qt ($nm^3/s$) | CALCULATED FLOW RATE Qc ($nm^3/s$) | RATIO Q/Qc |
|---|---|---|---|---|---|---|---|
| 2 | 0.32 | 0.07 | 8.31 | 11,867 | 99 | 7.18 | 1.14 |
| 5 | 0.13 | 0.62 | 1.89 | 74,169 | 140 | 10.17 | 0.80 |
| 5.5 | 0.12 | 0.62 | 1.29 | 89,744 | 116 | 8.41 | 0.97 |
| 6 | 0.11 | 0.73 | 1.07 | 106,803 | 114 | 8.32 | 0.98 |
| 7 | 0.09 | 0.91 | 0.72 | 145,371 | 105 | 7.62 | 1.07 |
| 8 | 0.08 | 1.30 | 0.60 | 189,872 | 115 | 8.33 | 0.98 |
| | | | | CORRECTION COEFFICIENT | 13.75 | | |

MSNP: MEASURED STABLE NEGATIVE PRESSURE

Figure 12:
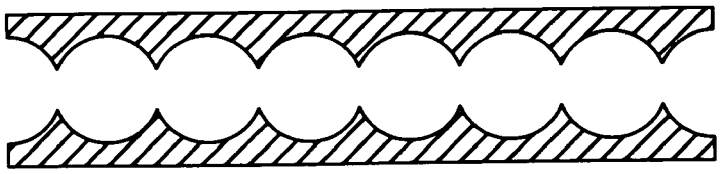
FIG. 12 is a cross-sectional view illustrating a state in which spherical or polyhedral cells are linked together in a beads-like manner in an actual foam material of the ink cartridge.

In the actual foam material, spherical or polyhedral cells are linked together in a beads-like manner, as shown in FIG. 12. The effective diameter is therefore smaller than the theoretical value because of the beads-like flow path. As such, an average multiplication factor with respect to the actual flow rate Q was calculated for the flow rate Qt that was obtained based on the theoretical cell diameter. The resultant value was then used as a correction coefficient k. In Table 2, the correction coefficient k is 13.75.

Figure 13:
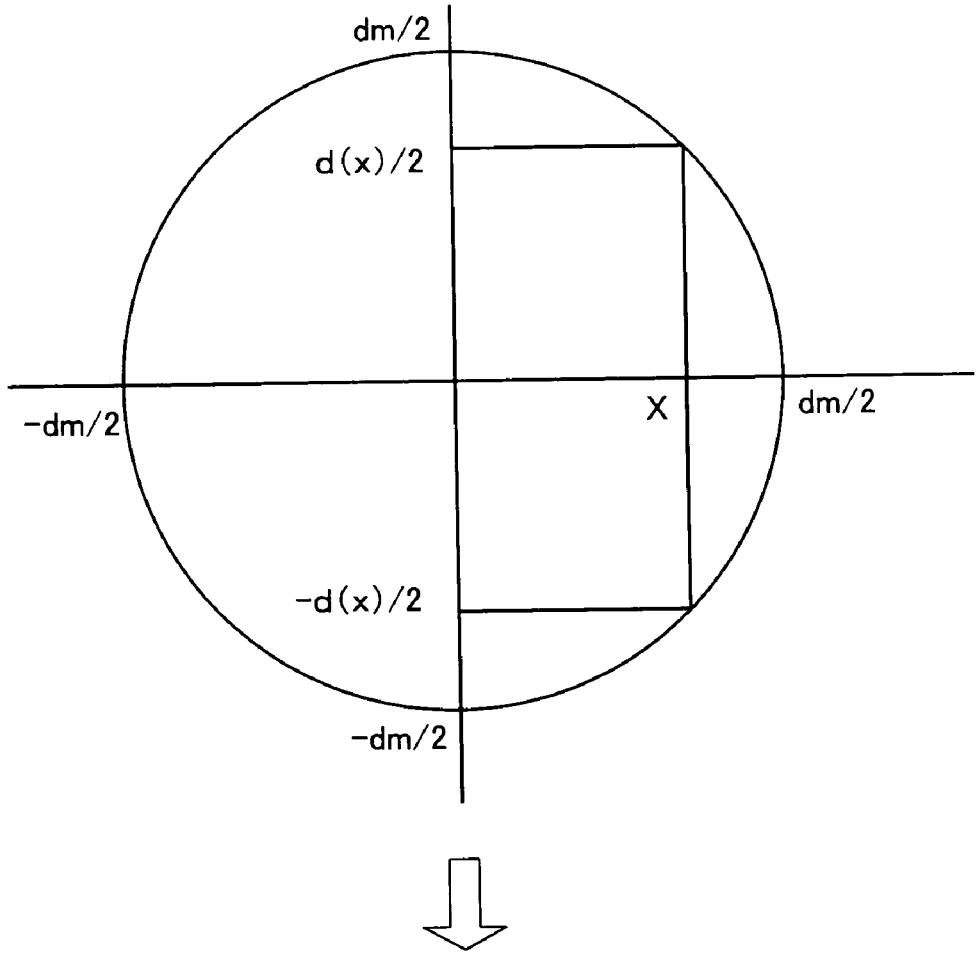
FIG. 13 is an explanatory diagram illustrating how effective diameter is calculated, assuming that the cells in an actual foam make up a flow path by being linked together in a beads-like manner.
Figure 14:
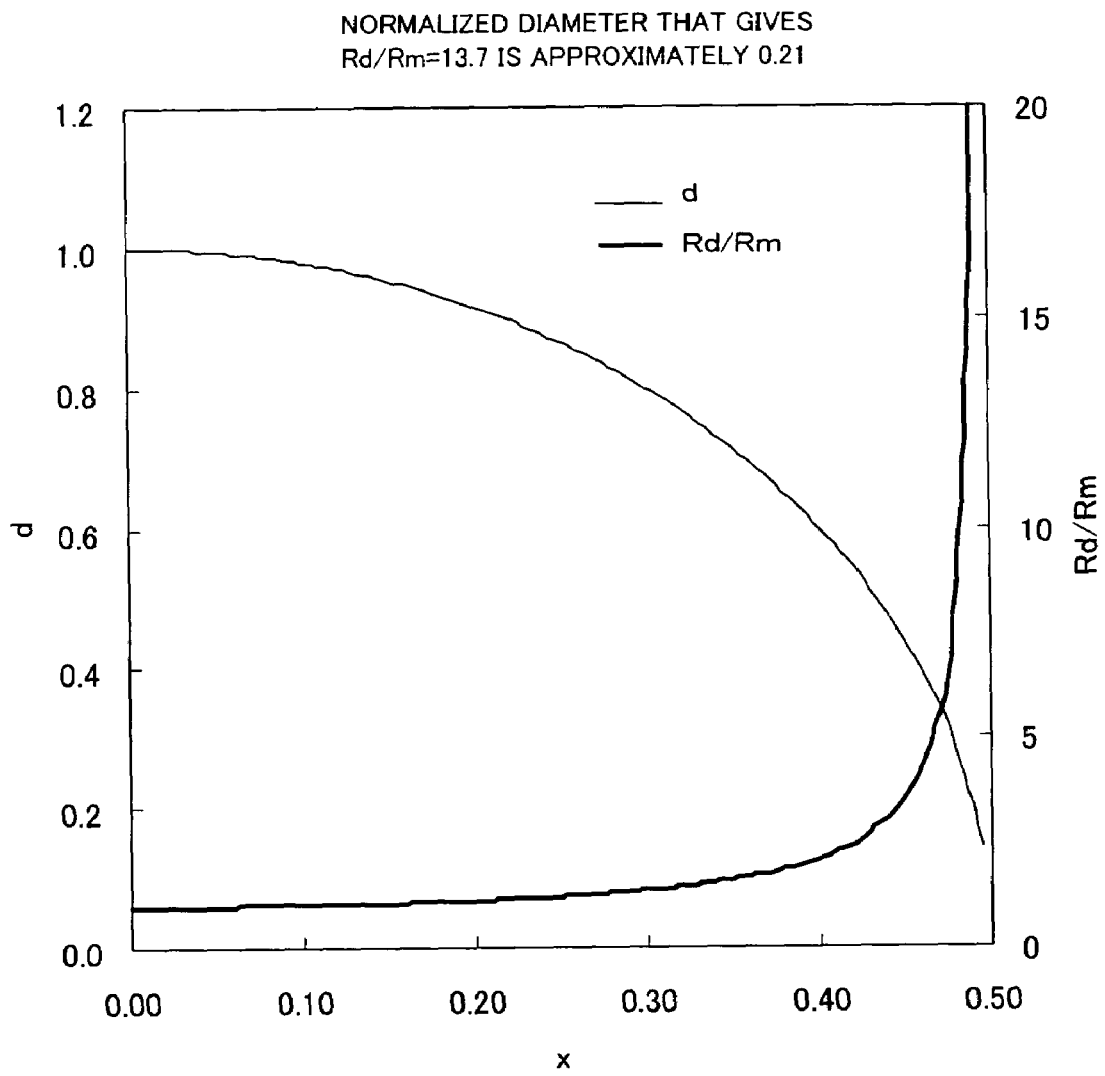
FIG. 14 is a graph illustrating a relationship between X and resistance ratio Rd/Rm and between X and cell diameter d, where Rd is the normalized flow path resistance calculated by performing integration on a spherical flow path by assuming that the center of the spherical flow path is X=0, and Rm is the normalized flow path resistance of a column-shaped flow path.

In the following, observation is made as to the correction coefficient k=13.75, which is obtained by actual measurement. FIG. 14 shows a resistance ratio Rd/Rm, where Rd is the normalized flow path resistance calculated by performing integration on a spherical flow path with a diameter dm and a center X=0 as shown in FIG. 13, and Rm is the normalized flow path resistance in the column-shaped flow path. As shown in FIG. 14, Rd/Rm≈1 when X is in a vicinity of 0, and Rd/Rm increases as X approaches dm/2. Assuming that a normalized cell diameter is 1, Rd/Rm=13.75 at X=0.488. This indicates that it is possible to create a model for the flow path where adjacent cells are linked together with a normalized diameter of 0.21. Thus, it is confirmed that the value of the correction coefficient k determined by actual measurement is indeed appropriate.

Accordingly, a flow rate Qc is calculated in accordance with the following expressions:

$$Qc=Qt/k \quad (5)$$

or $$Qc=(A/k)\cdot\Delta P\ S/\{\mu\cdot L\cdot(N\cdot R)^2\} \quad (4')$$

where (A/k) is a coefficient of $(A/k)=1.33\times10^{-6}$.

Here, because the respective values of Q/Qc are substantially equal to 1 in Table 2, it can be seen that the flow rate Q can be accurately calculated using the correction coefficient k.

On the other hand, according to Expressions (4) and (5), $$\Delta P=(k/A)\cdot\{\mu\cdot L\cdot(N\cdot R)^2/S\}\cdot Q \quad (6)$$

where (k/A) is a coefficient $(k/A)=7.52\times10^{-6}$.

Table 3 shows values of the pressure difference ΔP in the conduit, calculated using the actual flow rate Q.

TABLE 3

| C R | ACTUAL DENSITY M N*R | AVERAGE CELL DIAMETER d (mm) | MEASURED FLOW RATE Q ($nm^3/s$) | NUMBER OF FLOW PATHS Nd (number) | FLOW RATE q ($pm^3/s$) | PRESSURE ΔP (kPa) | PRESSURE Pc (kPa) | PRESSURE Pc/Ph |
|---|---|---|---|---|---|---|---|---|
| 2 | 80 | 0.32 | 8.17 | 11,867 | 0.688 | 0.0058 | 0.08 | 1.14 |
| 5 | 200 | 0.13 | 8.17 | 74,169 | 0.1101 | 0.0362 | 0.50 | 0.80 |
| 5.5 | 220 | 0.12 | 8.17 | 89,744 | 0.0910 | 0.0438 | 0.60 | 0.97 |
| 6 | 240 | 0.11 | 8.17 | 106,803 | 0.0765 | 0.0521 | 0.72 | 0.98 |
| 7 | 280 | 0.09 | 8.17 | 145,371 | 0.0562 | 0.0710 | 0.98 | 1.07 |
| 8 | 320 | 0.08 | 8.17 | 189,872 | 0.0430 | 0.0927 | 1.27 | 0.98 |
| 9 | 360 | 0.07 | 8.17 | 240,307 | 0.0340 | 0.1173 | 1.61 | — |
| 10 | 400 | 0.06 | 8.17 | 296,675 | 0.0275 | 0.1449 | 1.99 | — |
| 5.5 | 220 | 0.12 | 1.25 | 89,744 | 0.0139 | 0.0067 | 0.09 | — |

C: COMPRESSIBILITY

An average multiplication factor for a theoretical pressure was calculated with respect to the maximum ink stable negative pressure Ph, which is the actual pressure difference. The average multiplication factor so calculated was then used as a correction coefficient. The ratio Pc/Ph, which is the ratio of a calculated pressure difference Pc to the maximum ink stable negative pressure Ph, is substantially equal to 1.

Figure 15:
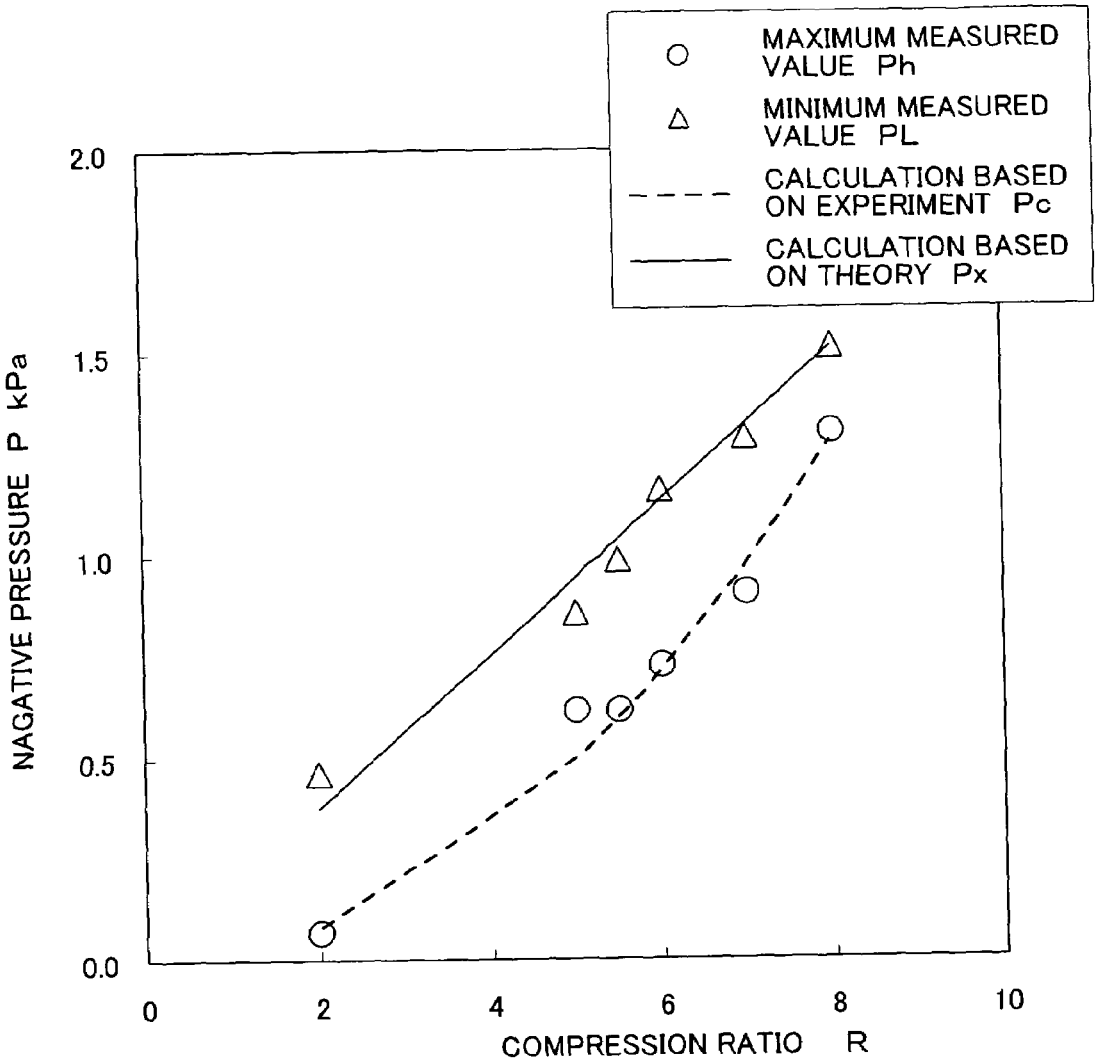
FIG. 15 is a graph showing a relationship between compressibility and negative pressure.
Figure 16:
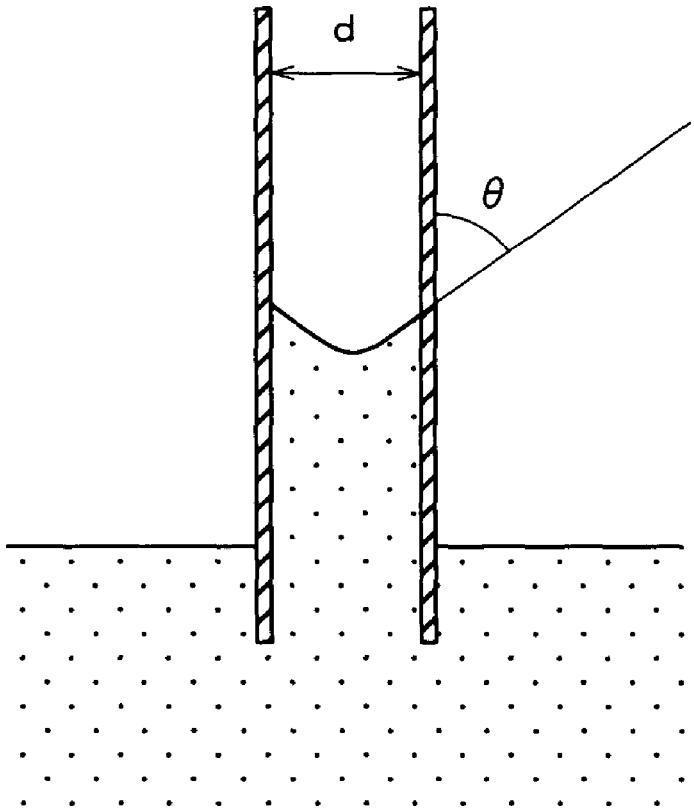
FIG. 16 is a schematic diagram illustrating critical pressure on a liquid surface (meniscus) in a capillary tube, assuming that cells at a lower end of the foam material make up a capillary tube in a state immediately before the ink in the ink cartridge is depleted.
Figure 17:
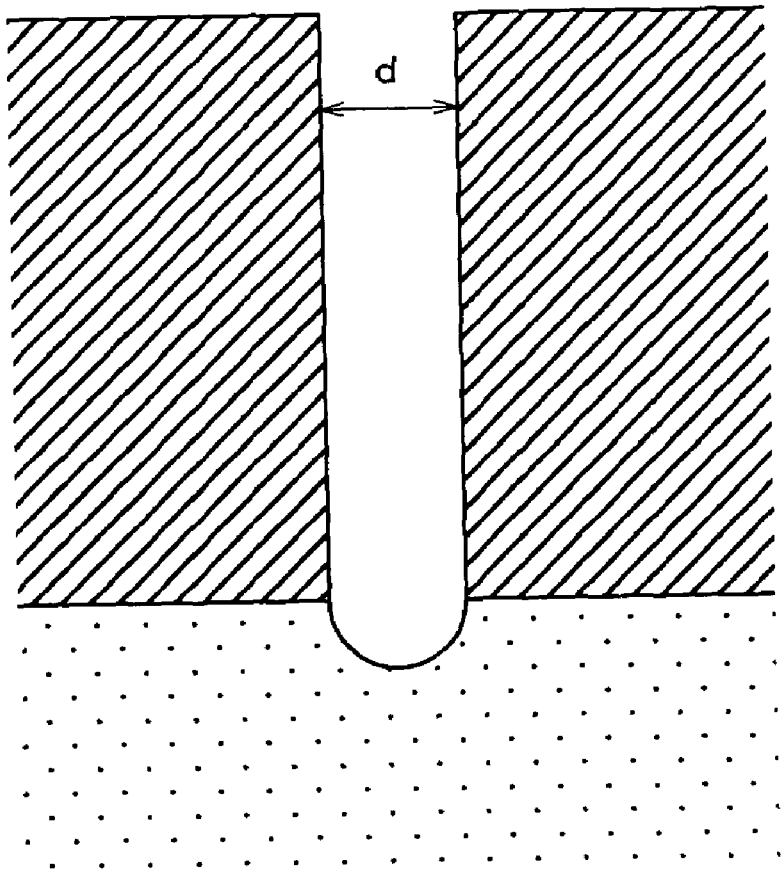
FIG. 17 is a schematic diagram illustrating critical pressure on a liquid surface (meniscus) in the capillary tube.

FIG. 15 is a graphical representation of Table 1 and Table 2. As shown in FIG. 15, there is a considerable overlap between the asymptotic pressures calculated using the theoretical values and the asymptotic pressures that are actually measured. This shows that the maximum ink asymptotic pressure Ph can be accurately calculated using the correction coefficient, because the maximum ink asymptotic pressure Ph is created by the pressure loss due to the viscosity of the ink.

When the ink is fully charged with ink (i.e. immediately before the ink in the ink cartridge 20 is depleted), the cells at the lower end of the foam material can be regarded as a capillary tube.

Therefore, the critical pressure Pt (Pa) of a liquid surface (meniscus) in the capillary tube is defined by the following Expression (7):

$$Pt=2\cdot T\cdot\cos\theta/(d/2) \quad (7).$$

where T is the surface tension (N/m) of the liquid (ink in the present invention) in the tube, θ is the contact angle, which is an angle at which the liquid surface contacts the tube, and d is the diameter (m) of the capillary tube. Because such an ink absorbing body 22 is used that has superior wettability to the ink (high affinity for the ink), the contact angle θ can be regarded as substantially equal to zero. Therefore, Expression (7) can be transformed as follows:

$$Pt\approx4\cdot T/D \quad (8).$$

It follows from this that, from Expressions (2) and (8), $$Pt=(4/0.0245)\cdot T\cdot(N\cdot R) \quad (9).$$

Table 4 shows values of the critical pressure Pt of the liquid surface in the capillary tube, calculated in accordance with Expression 9.

TABLE 4

| COMPRESSIBILITY R | ACTUAL DENSITY M N*R | AVERAGE CELL DIAMETER d (mm) | PRESSURE Px (kPa) | PRESSURE Px/PL |
|---|---|---|---|---|
| 2 | | 0.318 | 0.38 | 0.82 |
| 3 | 120 | 0.212 | 0.57 | — |
| 4 | 160 | 0.159 | 0.76 | — |
| 5 | 200 | 0.127 | 0.94 | 1.10 |
| 5.5 | 220 | 0.115 | 1.04 | 1.05 |
| 6 | 240 | 0.106 | 1.13 | 0.98 |
| 7 | 280 | 0.091 | 1.32 | 1.03 |
| 8 | 320 | 0.079 | 1.51 | 1.00 |
| 9 | 360 | 0.071 | 1.70 | — |
| 10 | 400 | 0.064 | 1.89 | — |

The ratio Px/PL, which is the ratio of theoretical critical pressure Px to minimum ink stable negative pressure PL (actual pressure) is substantially equal to 1. This confirms the theory that the minimum ink stable negative pressure PL depends on the critical pressure of the capillary tube generated by the surface tension of the ink, and that the minimum ink stable negative pressure PL can be accurately calculated.

A condition for preventing the problem of accidental ink leakage caused when the ink cartridge 20 is inserted or detached is that the critical pressure, which is the ink retaining power of the foam material, needs to be larger than the ink head pressure.

In the ink cartridge 20, the head pressure is $9.8\times10^3\cdot\gamma\cdot h$ (Pa) when it is assumed that the ink has a head height h(m) relative to the ink supplying throat 24, and that the specific gravity of the ink is γ. Therefore, the critical pressure Pt (Pa) in Expression (9) may satisfy the following condition:

$$T\cdot N\cdot R\cdot B\geqq\gamma\cdot h \tag{10}$$

where B is a coefficient B=0.0161.

(150) Moreover, the cell density of the foam material contained in the ink cartridge 20, that is, the actual cell density M=N·R (cells/inch), is given by:

$$M=40\times5.5\times1.1=242/\text{inch}$$

when, for example, the ink absorbing body 22 whose cell density is N=40/inch and which is compressed at a compressibility of R=5 is further compressed by 10% by containment in the ink cartridge 20.

Therefore, by substituting the actual cell density M (cells/inch) in Expression (9), the following condition is obtained.

$$T\cdot M\cdot B\geqq\gamma\cdot h \tag{11}$$

where B is a coefficient B=0.0161.

The actual cell density M used here may be a measured value.

The head height h of the ink relative to the ink supplying throat 24, under usual orientation, may be the height of the foam material, or the height of inner walls of the ink cartridge 20.

If different orientations of the ink cartridge 20 need to be taken into account, the head height h is the maximum vertical height relative to the supplying throat of the ink cartridge 20, irrespective of how the ink cartridge 20 is positioned or inclined.

Considering a distribution of cell diameter for example, the safety factor is no less than 2. Therefore, $$T\cdot N\cdot R\cdot B\geqq2\cdot\gamma\cdot h \tag{12}$$

or $$T\cdot M\cdot B\geqq2\cdot\gamma\cdot h \tag{13}$$

where B is a coefficient B=0.0161.

Commonly, the ink cartridge has a height less than approximately 40 mm, taking into account fluctuations of the ink level. Therefore, the critical pressure is about 0.8 kPa (0.08 $mH_2O$) when the safety factor is 2. The critical temperature can be maintained at or above 0.8 kPa by satisfying $$T\cdot N\cdot R\cdot B\geqq0.08 \tag{14}$$

or $$T\cdot M\cdot B\geqq0.08 \tag{15}$$

where B is a coefficient B=0.0161. In this way, it is possible to prevent the problem of accidental ink leakage caused when the ink cartridge 20 is inserted or detached.

Here, in the graphical representation of Tables 2 and 3 as shown in FIG. 15, there is a significant overlap between the calculated asymptotic pressures according to the theoretical values and the asymptotic values that were actually measured. Table 4 and FIG. 1 show negative pressures for the actual cell densities M (≈N·R) under different settings.

Next, a critical pressure Pn is calculated that is created when the ink retreats at an orifice in response to ink ejection from an ink nozzle.

Assuming that the ink flow rate is Q=8.17 $nm^3/s$ (0.49 cc/min) in a setting where the ink ejection frequency is 8000 pps and the number of nozzles is 64, a drop of ink is:

$$0.00817/8000/64=1.6\times10^{-8}\ (\text{cc}).$$

It is assumed that, as shown in FIG. 8, the orifice is shaped to have a round nozzle that is 20 μm in diameter and 20 μm in length, and that a frustum of a cone having an apex angle of 90° and an apex circle diameter of 20 μm extends from an end of the nozzle.

Figure 18:
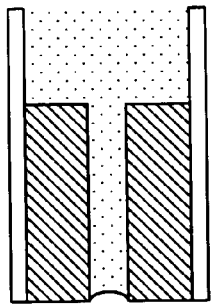
FIGS. 18(*a*) to 18(*h*) are cross-sectional views illustrating how the ink is ejected from a nozzle in steps.
Figure 18:
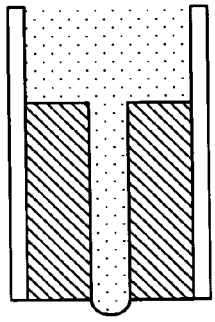
Figure 18:
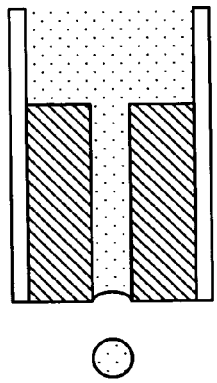
Figure 18:
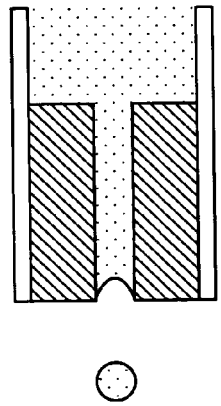
Figure 18:
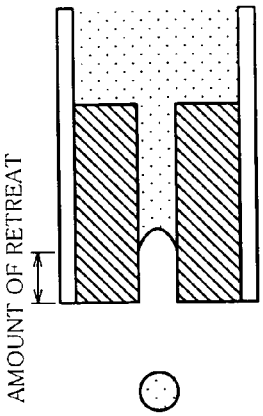
Figure 18:
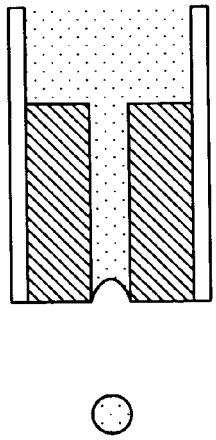
Figure 18:
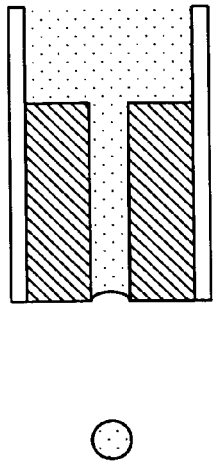
Figure 18:
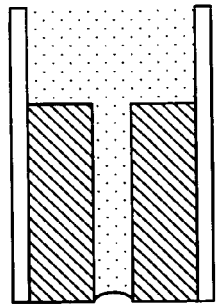

On this assumption, Table 5 shows diameter H of the cone portion measured on a liquid surface of the ink that has retreated in response to ejection of the ink. In Table 5, the diameter H=20 μm is the diameter at the tip of a nozzle that has been processed to have a sufficiently long straight portion, for example, by excimer laser processing. An ink droplet had two volumes: $1.6\times10^{-8}$ (cc) and $1.8\times10^{-8}$ (cc). For each volume of ink droplet, measurement was made under two different conditions: one not considering transient vibration of the meniscus at the end of the nozzle; and one considering transient vibration of the meniscus at the end of the nozzle so that the amount of ink retreat is twice as much as the amount of the ink ejected, as shown in FIG. 18(*a*) through FIG. 18(*h*).

The critical pressure Pn of the nozzle can be given as follows by plugging the diameter H (m) of the cone portion into Expression (8):

$$Pn\approx4\cdot T/H \tag{8'}$$

A condition for not causing depletion of the ink is abs (Pn)>abs (Ph). When the diameter of the nozzle is D(m), Expressions (6) and (8') gives $$(k/A)\cdot\{\mu\cdot L\cdot(N\cdot R)^2/S\}\cdot Q\leqq4\cdot T/D \tag{16}$$

Expression (16) can be rearranged into $$C\cdot\{\mu\cdot L\cdot Q\cdot(N\cdot R)^2/S\}\leqq T/D \tag{17}$$

where C is a coefficient of $C=(k/A)/4=1.88\times10^5$.

By plugging the actual cell density M (number/inch) into Expression (17), the condition is $$C\cdot\{\mu\cdot L\cdot Q\cdot(M)^2/S\}\leqq T/D \tag{18}$$

where C is a coefficient of $C=(k/A)/4=1.88\times10^5$.

Table 5 shows values of critical pressure Pn (kPa), calculated according to Expression (8') under different settings.

Table 5 indicates that the critical pressure Pn, which is the ink drawing force generated by the meniscus that has retreated at the end of the nozzle after the ejection of the ink, becomes larger than the negative pressure of the ink supply system when the negative pressure of the supply system is no more than 1.88 kPa (approximately 2.0 kPa) in continuous ejection of the ink, by taking into consideration the safety ratio, that is, errors in transient vibration and flow rate. As a result, it is possible to stably supply an amount of ink even during continuous ejection of the ink.

Therefore, by so setting the negative pressure of the supply system to be no larger than approximately 2.0 kPa, it is possible to prevent the problem that the negative pressure generated by the supply system causes depletion of the ink, and that that air is sucked into the nozzle as the liquid level of the ink retreats too much from the end of the nozzle. As a result, it is possible to stably supply the ink even when continuous ejection of the ink is carried out.

To summarize the above analysis, the condition required for the cell density N and compressibility R of the foam material is given as follows from Expressions (9) and (17).

$$\{T\cdot S/(C\cdot D\cdot\mu\cdot L\cdot Q)\}^{0.5}\geqq N\cdot R\geqq\gamma\cdot h/(T\cdot B) \quad (19)$$

where C is a coefficients of $C=1.88\times10^5$, and B=0.0161.

The condition for the actual cell density M=N·R (number/inch) is given as follows from Expressions (10) and (18).

$$\{T\cdot S/(C\cdot D\cdot\mu\cdot L\cdot Q)\}^{0.5}\geqq M\geqq\gamma\cdot h/(T\cdot B) \quad (20)$$

where C is a coefficient of $C=1.88\times10^5$, and B=0.0161.

By satisfying Expression (19) or Expression (20), it is possible to prevent ink leakage when the ink cartridge is inserted or detached, and to stably supply ink when continuous ejection is carried out.

TABLE 5

| CONDITION | H (μm) | Pn (kPa) |
|---|---|---|
| NOZZLE ONLY | 20 | 6.00 |
| $1.6\times10^{-8}$ (cc) TRANSIENT VIBRATION NOT CONSIDERED | 42 | 2.84 |
| $1.8\times10^{-8}$ (cc) TRANSIENT VIBRATION NOT CONSIDERED | 58 | 2.06 |
| $1.6\times10^{-8}$ (cc) TRANSIENT VIBRATION CONSIDERED | 47 | 2.54 |

TABLE 5-continued

| CONDITION | H (μm) | Pn (kPa) |
|---|---|---|
| $1.8\times10^{-8}$ (cc) TRANSIENT VIBRATION CONSIDERED | 64 | 1.88 |

In order to suppress negative pressure of the supply system at or below 2.0 kPa, the following Expression (21) should be satisfied from Expression (6).

$$(k/A)\cdot\{\mu\cdot L\cdot Q\cdot(N\cdot R)^2/S\}\leqq2000 \quad (21)$$

where (k/A) is a coefficient of $(k/A)/4=7.52\times10^5$.

By plugging the actual cell density M (cells/inch) into Expression (21), the condition is given as $$(k/A)\cdot\{\mu\cdot L\cdot Q\cdot M^2/S\}\leqq2000 \quad (22)$$

where (k/A) is a coefficient $(k/A)=7.52\times10^5$.

(170) By satisfying Expression (21) or Expression (22), it is possible to stably supply ink when the ink is ejected. It should be noted that the present invention is not limited to the embodiment described above, and the same may be varied in many ways within the scope of the invention. For example, in the embodiment described above, the analysis was made under the conditions where the viscosity of the ink is μ=0.07 (Pa·s) (=7 cp), the surface tension of the ink is T=0.03 (N/m) (=30 dyn/cm), and the cell density of the foam material is N=40 (cells/inch)=1.57 (cells/mm).

However, the present invention is not just limited to this setting, and can be implemented under other conditions as well. The conditions commonly adopted for the ink of ink jet printers are:

Viscosity μ=0.015 to 0.15 (Pa·s);

Surface tension of the ink T=0.03 to 0.05 (N/m); and

Cell density of the foam material N=40 to 100 (cells/inch).

In view of this, for example, the following conditions were used for analysis

Viscosity μ=0.015 (Pa·s),

Surface tension of the ink T=0.04 (N/m), and

Cell density of the foam material N=80 (cells/inch).

The results are shown in Table 6 and Table 7 below, which correspond to Table 3 and Table 4, respectively.

TABLE 6

| C R | ACTUAL DENSITY M N*R | AVERAGE CELL DIAMETER d (mm) | MEASURED FLOW RATE Q ($nm^3/s$) | NUMBER OF FLOW PATHS Nd (number) | FLOW RATE q ($pm^3/s$) | PRESSURE ΔP (kPa) | Pc (kPa) |
|---|---|---|---|---|---|---|---|
| 1 | 80 | 0.32 | 8.17 | 11,867 | 0.688 | 0.0012 | 0.02 |
| 2.5 | 200 | 0.13 | 8.17 | 74,169 | 0.1102 | 0.0078 | 0.11 |
| 2.75 | 220 | 0.12 | 8.17 | 89,744 | 0.0910 | 0.0094 | 0.13 |
| 3 | 240 | 0.11 | 8.17 | 106,803 | 0.0765 | 0.0112 | 0.15 |
| 3.5 | 280 | 0.09 | 8.17 | 145,371 | 0.0562 | 0.0152 | 0.21 |
| 4 | 320 | 0.08 | 8.17 | 189,872 | 0.0430 | 0.0199 | 0.27 |
| 4.5 | 360 | 0.07 | 8.17 | 240,307 | 0.0340 | 0.0252 | 0.35 |
| 5 | 400 | 0.06 | 8.17 | 296,675 | 0.0275 | 0.0311 | 0.43 |

TABLE 7

| COMPRESSIBILITY R | ACTUAL DENSITY M N*R | AVERAGE CELL DIAMETER d (mm) | PRESSURE Px (kPa) |
|---|---|---|---|
| 1 | 80 | 0.64 | 0.25 |
| 1.5 | 120 | 0.42 | 0.38 |
| 2 | 160 | 0.32 | 0.50 |
| 2.5 | 200 | 0.25 | 0.63 |
| 2.75 | 220 | 0.23 | 0.69 |
| 3 | 240 | 0.21 | 0.76 |
| 3.5 | 280 | 0.18 | 0.88 |
| 4 | 320 | 0.16 | 1.01 |
| 4.5 | 360 | 0.14 | 1.13 |
| 5 | 400 | 0.13 | 1.26 |

It was found that Expressions (1) to (22) were also satisfied under these conditions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink cartridge, comprising:

an ink containing section including an ink absorbing body made of a porous material for retaining ink, the ink cartridge satisfying:

$$C\cdot\{\mu\cdot L\cdot Q\cdot(N\cdot R)^2/S\}\leqq T/D$$

where C is a coefficient of $C=1.88\times10^5$; $\mu$ is a viscosity of the ink in Pa·s; L is a height in meter of the ink absorbing body when the ink absorbing body is contained in a compressed state in the ink containing section; Q is a maximum amount of ink, expressed in cubic meter per second, ejected from a nozzle through which the ink containing section ejects ink; N is a cell density, expressed in the number of pores per inch, of the ink absorbing body before the ink absorbing body is contained in the ink containing section; R is a compressibility, which is a volume ratio of the ink absorbing body when the ink absorbing body is contained in a compressed state in the ink containing section to the ink absorbing body before the ink absorbing body is contained in the ink containing section; S is a cross-sectional area of the ink absorbing body, expressed in square meter, when the ink absorbing body is contained in a compressed state in the ink containing section; T is a surface tension of the ink, expressed in Newton per meter, absorbed in the ink absorbing body; and D is a diameter of the nozzle expressed in meter.

2. An image forming apparatus comprising an ink cartridge that includes:

an ink containing section including an ink absorbing body made of a porous body for retaining ink, the ink cartridge satisfying:

$$C\cdot\{\mu\cdot L\cdot Q\cdot(N\cdot R)^2/S\}\leqq T/D$$

where C is a coefficient of $C=1.88\times10^5$; $\mu$ is a viscosity of the ink in Pa·s; L is a height in meter of the ink absorbing body when the ink absorbing body is contained in a compressed state in the ink containing section; Q is a maximum amount of ink, expressed in cubic meter per second, ejected from a nozzle through which the ink containing section ejects ink; N is a cell density, expressed in the number of pores per inch, of the ink absorbing body before the ink absorbing body is contained in the ink containing section; R is a compressibility, which is a volume ratio of the ink absorbing body when the ink absorbing body is contained in a compressed state in the ink containing section to the ink absorbing body before the ink absorbing body is contained in the ink containing section; S is a cross-sectional area of the ink absorbing body, expressed in square meter, when the ink absorbing body is contained in a compressed state in the ink containing section; T is a surface tension of the ink, expressed in Newton per meter, absorbed in the ink absorbing body; and D is a diameter of the nozzle expressed in meter.

* * * * *